US005424814A

United States Patent [19]

Suzuki et al.

[11] Patent Number: 5,424,814

[45] Date of Patent: Jun. 13, 1995

[54] DEVELOPING DEVICE WITH MICROFIELDS FORMED ON DEVELOPER CARRIER

[75] Inventors: Koji Suzuki; Katsuhiro Aoki, both of Yokohama; Yuichi Ueno, Kawasaki; Akira Sawada, Yokohama; Naoki Iwata; Takatsugu Fujishiro, both of Tokyo; Shigeki Sawa, Yokohama, all of Japan

[73] Assignee: Ricoh Company, Ltd., Tokyo, Japan

[21] Appl. No.: 998,667

[22] Filed: Dec. 30, 1992

[30] Foreign Application Priority Data

Jan. 11, 1992 [JP] Japan ..... 4-022072
Dec. 7, 1992 [JP] Japan ..... 4-351338

[51] Int. Cl.[6] ..... G03G 13/08
[52] U.S. Cl. ..... 355/259; 118/651; 118/653; 355/245
[58] Field of Search ..... 355/245, 246, 253, 259; 118/651, 653, 656

[56] References Cited

U.S. PATENT DOCUMENTS 3,203,394 8/1965 Hope et al. .
4,382,420 5/1983 Ohnuma et al. .
5,172,169 12/1992 Takashima et al. ..... 355/246

FOREIGN PATENT DOCUMENTS 2163371 2/1986 United Kingdom .
2237407 5/1991 United Kingdom .

OTHER PUBLICATIONS

Patent Abstracts of Japan, vol. 7, No. 87 P-190, Apr. 12, 1983, and JP-A-58-14166, Jan. 26, 1983.
Patent Abstracts of Japan, vol. 10, No. 36 P-524, Dec. 5, 1986, and JP-A-61-159675, Jul. 19, 1986.

*Primary Examiner*—R. L. Moses
*Attorney, Agent, or Firm*—Oblon, Spivak, McClelland, Maier & Neustadt

[57] ABSTRACT

A developing device for an image forming apparatus and using a one component type developer. The developer is transferred from a developer supply member to a developer carrier which are so rotated as to move in the same direction at a position where they contact each other. This prevents the developer from a toner storing section from directly reaching part of the developer carrier having moved away from the contact position despite the movement of the developer supply member. Conductive portions connected to ground and dielectric portions each having a small area are distributed regularly or irregularly on the surface of the developer carrier. Such a surface of the developer carrier is charged by friction by the developer supply member with the result that a great number of microfields are formed in the vicinity of the developer carrier. The microfields allow only the developer sufficiently charged by friction at the contact position to form multiple layers on the surface of the developer carrier. Consequently, the toner with a desired amount of charge and containing a minimum of uncharged toner can form multiple layers on the developer carrier and is transferred to an image carrier.

26 Claims, 17 Drawing Sheets

DEVELOPING DEVICE WITH MICROFIELDS FORMED ON DEVELOPER CARRIER

BACKGROUND OF THE INVENTION

The present invention relates to a developer for a copier, facsimile transceiver, printer or similar image forming equipment and using a one component type developer, i.e., a toner.

With image forming equipment of the type forming an electrostatic latent image on an image carrier and then developing it by a developer, it is advantageous to use a developing device operable with a one component type developer, i.e., a toner in respect of the size, cost, reliability, etc. Regarding color images, use is advantageously made of a nonmagnetic toner having inherently high clearness. To deposit a predetermined charge on the toner and transport it to a developing region where the image carrier is located, the developing device may be provided with a developer carrier and a developer supply member for feeding the toner to the developer carrier. The developer carrier is driven such that the surface thereof passes a position where the developer carrier faces the image carrier. For example, Japanese Patent Laid-Open Publication No. 42672/1986 discloses a developing device having a developer carrier in the form of a developing roller of medium resistance ($10^9$ Ωcm to $10^{11}$ Ωcm) and having a float electrode, and a developer supply member implemented as a sponge roller made of, for example, polyurethane. The developing roller and sponge roller are pressed against each other and rotated such that their surfaces move in opposite directions at the position where they contact. A blade, or layer forming member, is pressed against the developing roller at a predetermined pressure to cause the toner to deposit on the roller in a predetermined amount. The toner conveyed to the contact position by the sponge roller is frictionally charged at the contact position and then deposited on the developing roller. The blade regulates the toner on the developing roller to form a toner layer having a predetermined thickness. The developing roller transports the regulated toner layer to a position where the roller contacts a photoconductive element, or image carrier, thereby developing a latent image electrostatically formed on the element.

Regarding the developing system using a one component type developer, e.g., a nonmagnetic one component type developer, an optimal amount of charge and an optimal amount of deposition of the toner are as follows. Preferably, the amount of charge should be 5 μc/g to 10 μc/g in mean value, and the charge distribution should be stable, i.e., contain a minimum amount of relatively low charge toner which would reduce sharpness and resolution and contaminate the background. On the other hand, the toner deposition on the developing roller should preferably be such that the toner deposits on the image carrier in an amount of about 0.6 mg/cm$^2$ to about 1.0 mg/cm$^2$ or deposits on a recording medium in an amount of about 0.5 mg/cm$^2$ to about 0.7 mg/cm$^2$. The amount of toner deposition on the image carrier and recording medium are affected not only by the amount of toner on the developing roller but also by the relative speed of the image carrier and developing roller in the developing region.

However, the problem with the conventional developing device is that the toner is deposited on the developing roller only in a single layer. Specifically, while the charge deposited on the toner to reach the developing region is about 5 μc/g to about 15 μc/g in mean value, the amount of toner deposition on the developing roller is as small as 0.2 mg/cm$^2$ to 0.8 mg/cm$^2$. It follows that a desired amount of toner cannot be deposited on, for example, the image carrier unless the developing roller is rotated at twice to four times higher speed than the image carrier. When the rotation speed of the developing roller is increased to compensate for the short amount of toner on the developing roller, it is difficult to increase the image forming speed. Moreover, the higher rotation speed undesirably increases the density at the trailing edge portion of a solid image. Although this kind of phenomenon does not matter at all when a black-and-white image is produced, it increases the density at the trailing edge portion of a color image since a color is perceived through the toner. Particularly, when a plurality of color images are superposed to form a composite color image, the colors are brought out of register.

Therefore, to achieve a desired amount of toner deposition on, for example, the image carrier without the above-stated local increase in density, it is necessary to drive the developing roller at a speed close to the speed of the image carrier, i.e., to effect substantially equispeed development and to deposit a greater amount of toner on the developing roller than conventional. Specifically, to deposit a sufficient amount of toner on the image carrier and recording medium by equispeed development, it is necessary that the toner be deposited on the developing roller in an amount of at least 0.8 mg/cm$^2$ in the case of contact type development or in an amount of at least 10 mg/cm$^2$ in the case of noncontact type development. The contact type development is higher in developing efficiency than the noncontact type development. Such an amount of toner deposition on the developing roller is not achievable unless the toner forms two or more layers on the roller.

Two or more toner layers will be achieved only if the previously mentioned blade is pressed against the developing roller at a lower pressure. However, this approach is not desirable for the following reasons. In the conventional developing device, the developing roller and the sponge roller are moved in opposite directions at the position where they contact, as stated earlier. Hence, an uncharged toner is also fed to part of the surface of the developing roller having moved away from the contact position by the sponge roller. As a result, an upper toner layer formed on the developing roller and reaching the position where the blade contacts the roller contains a great amount of uncharged toner. It follows that the charge distribution of the toner existing in part of the developing roller having moved away from the blade is less than 10 μc/g and, moreover, uncharged toner and toner charged to opposite polarity are contained. The uncharged toner cannot be transferred in a desirable manner and, therefore, contaminates the background and lowers the resolution.

As stated above, the key to a high image forming speed and the equispeed development which eliminates the local increase in image density is to form on the developing roller two or more toner layers with a stable charge distribution, i.e., with no uncharged toner even in the uppermost layer and having a mean amount of charge ranging from 5 μc/g to 10 μc/g.

SUMMARY OF THE INVENTION

It is, therefore, an object of the present invention to provide a developing device for image forming equipment which forms on a developer carrier multiple toner layers with a minimum of uncharged toner and a desired amount of charge and then feeds it to an image carrier.

In accordance with the present invention, a developing device incorporated in image forming equipment for developing a latent image electrostatically formed on an image carrier by a developer to produce a visible image has a developer carrier driven to move the surface thereof and having conductive portions connected to ground and dielectric portions distributed regularly or irregularly on the surface together with the conductive portions. The conductive portions and dielectric portions each has an extremely small area. A developer supply member is driven to move the surface thereof while contacting the surface of the developer carrier for supplying the developer to the developer carrier. The surface of the developer supply member is moved in the same direction as the surface of the developer carrier at a contact position where the surfaces contact each other. A great number of microfields are formed in the vicinity of the surface of the developer carrier due to friction between the developer supply member and the developer carrier, and the developer charged by friction at the contact position is deposited a layer on the developer carrier by in the microfields.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1A:
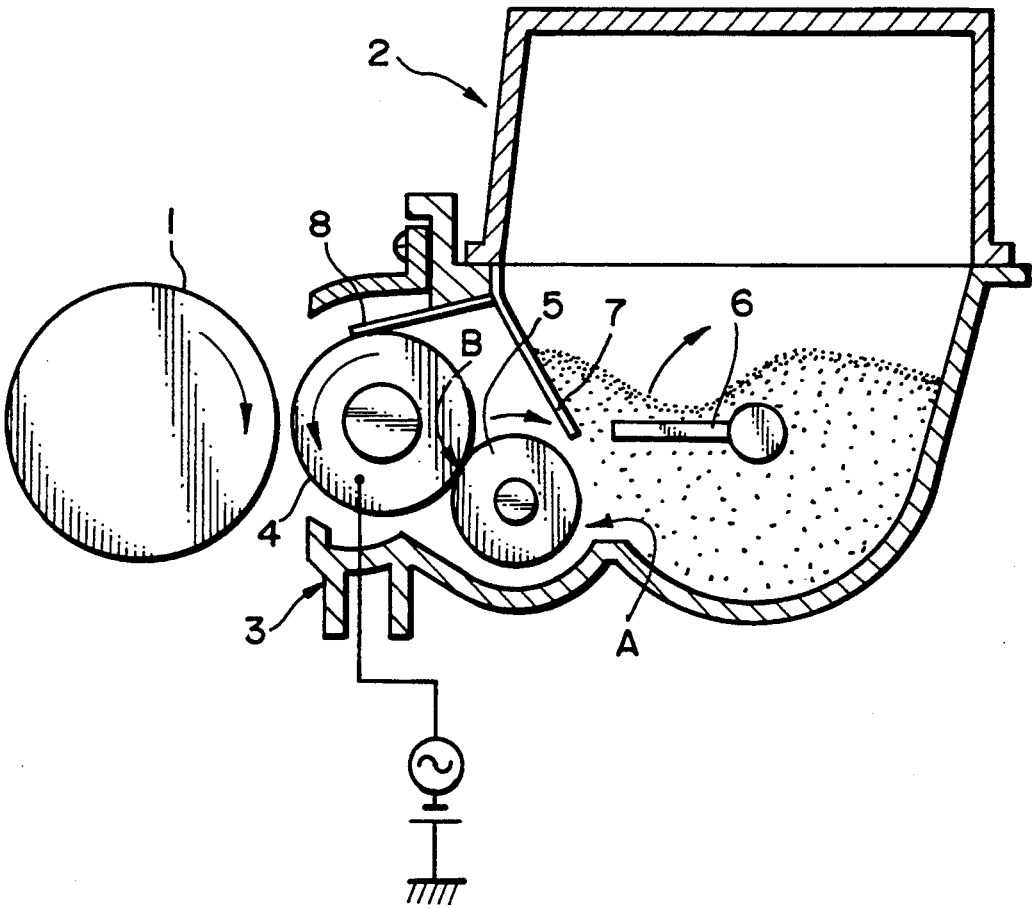
FIG. 1A is a section showing essential part of a developing device embodying the present invention.

Referring to FIG. 1A of the drawings, a developing device embodying the present invention is shown which is applied to an electrophotographic copier by way of example. As shown, the developing device, generally 2, is located at the right-hand side of a photoconductive drum 1 which is a specific form of an image carrier. The drum 1 is rotated at a peripheral speed of, for example, 120 mm/sec in a direction indicated by an arrow in the figure. Arranged around the drum 1 are a conventional charger, optics for exposure, image transfer and paper separation unit, cleaning device, and a discharger, although not shown in the figure.

The developing device 2 has a casing 3 having an opening which is directed toward the surface of the drum 1. A developing roller 4 is accommodated in the casing 3 and partly exposed through the opening of the casing 3. The developing roller 4 is rotated at a predetermined peripheral speed in a direction also indicated by an arrow in the figure. A toner supply roller, or developer supply member, 5 is pressed against right part of the developing roller 4 and rotated in a direction indicated by an arrow in the figure. A hopper, no numeral, is contiguous with right part of the casing 3 and stores a nonmagnetic toner, or simply toner as referred to hereinafter, therein. An agitator 6 is disposed in the hopper and supplies the toner to the surface of the toner supply roller 5 while agitating it. A wall 7 plays the role of a regulating member for preventing the toner in the hopper from directly reaching the vicinity of the surface of the developing roller 4. A leveling plate 8 levels the toner being transported by the developing roller 4 toward a developing region where the roller 4 faces the drum 1, thereby forming a toner layer of uniform thickness.

The casing 3 is configured such that the inner periphery thereof beneath the toner supply roller 5 is spaced apart from the surface of the roller 5 by a predetermined distance.

In the illustrative embodiment, a predetermined gap exists between the drum 1 and the developing roller 4 so as to effect noncontact type development. Alternatively, the toner layer on the developing roller 4 may be held in contact with the drum 1 to effect contact type development. In any case, to prevent toner from increasing in amount in the trailing edge portion of an image, the developing roller 4 is so rotated as to move, in the developing region, in the same direction as the drum 1 and at substantially the same peripheral speed as the drum 1, i.e., about 120 mm/sec in the embodiment. However, in the case of contact type development, should the roller 4 be rotated at exactly the same peripheral speed as the drum 1, the toner might physically deposit on the drum 1 with no regard to the surface potential of the drum 1. To eliminate this occurrence, the roller 4 is rotated at a slightly higher peripheral speed than the drum 1, preferably at a peripheral speed ratio (drum 1:roller 4) of 1:1.05–1.1. Such a speed prevents the above-mentioned local increase of the toner in an image from becoming conspicuous. A suitable bias voltage, e.g., DC, AC, DC-superposed AC or pulse voltage is applied to the roller 4. When noncontact type development is selected, it is preferable to adopt a voltage having an alternating component (e.g. AC, DC-superposed AC or pulse voltage) in respect of the flight of the toner.

Figure 1B:
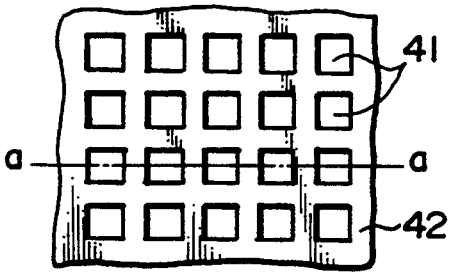
FIG. 1B is a fragmentary plan view of the surface of a developing roller included in the embodiment.
Figure 1C:
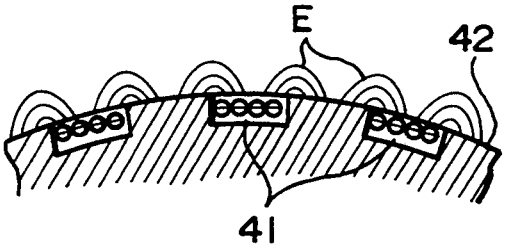
FIG. 1C is a section along line a—a of FIG. 1B.

As shown in FIGS. 1B and 1C, in the embodiment, dielectric portions 41 and conductive portions 42 connected to ground are distributed together regularly or irregularly on the surface of the developing roller 4. Having a small area each, the two different portions 41 and 42 serve to increase the amount of toner to deposit on the surface of the roller 4. The dielectric portions 41 each has a diameter of, for example, about 50 μm to about 200 μm. Preferably, the dielectric portions 41 should occupy about 40% to 70% of the surface of the roller 4. The dielectric portions 41 are made of a material having a resistance which prevents a charge from depositing on the portions 41 despite the friction between the rollers 4 and 5, as will be described later specifically.

The toner supply roller 5 should preferably be implemented as a roller with a sponge layer or a fur brush with a great number of hairs implanted therein, so that the toner may be held in part of the roller 5 adjoining the surface. At least the surface of the roller 5 is formed of a material intermediate between the toner and the developing roller 4 with respect to a frictional charge series, so that it may deposit a desired charge on the toner and roller 4 in contact with the roller 4. Further, the material forming the surface of the roller 5 should preferably have a resistance not depositing a countercharge in the event of charging the toner and the minute dielectric areas 41 of the roller 4, as will also be described later specifically. At a position B where the rollers 4 and 5 contact, the surface of the roller 4 moves in the same direction as that of the roller 5. Preferably, the peripheral speed of the roller 5 is about 0.5 to about 1.5 times as high as that of the roller 4. If desired, a voltage similar to the voltage applied to the roller 4 may also be applied to the metallic core of the roller 5.

The agitator 6 having the previously mentioned function may be omitted if the toner can be fed to the surface of the toner supply roller 5 by gravity due to the configuration of the hopper and the fluidity of the toner. The upper edge of the wall 7 is affixed to the upper wall of the casing 3 while the lower edge of the same is located in close proximity to the surface of the roller 5. The wall 7, therefore, prevents the toner in the hopper from directly advancing to a position adjacent to part of the surface of the developing roller 4 having moved away from the contact position B. The wall 7 may also be omitted if the configuration of the hopper, for example, prevents the toner from directly reaching the above-mentioned position. The leveling plate 8 is pressed against the roller 4 at a pressure as low as about 10 g/cm to about 20 g/cm so as to level the toner layer formed on the roller 4 in contact with the roller 4. The plate 8 may also be omitted if the toner layer on the roller 4 moved away from the contact position B can form a sufficiently thick uniform layer.

Part of the surface of the toner supply roller 5 is exposed to the hopper at a supply position A which is delimited by the lower edge of the wall 7 and the inner periphery of the lower wall of the casing 3. In operation, the agitator 6 feeds the toner from the hopper to the exposed part of the roller 5. At this instant, the wall 7 prevents the uncharged toner stored in the hopper from reaching the surface of the developing roller 4. On reaching the roller 5, the toner is retained by the pores and surface of the sponge or brush and is transported by the roller 5 toward the position where the roller 5 contacts the roller 4. On the other hand, as the roller 4 is rotated counterclockwise, part of the roller 4 having moved away from the developing region also enters the position B where the rollers 4 and 5 contact. At this position B, since the surfaces of the rollers 4 and 5 move at different speeds, the toner left on the roller 4 without being transferred to the drum 1 is removed by the roller (e.g. sponge roller) 5 mechanically and electrically. Also, the charges remaining on the roller 4 are uniformized by the friction between the rollers 4 and 5. As a result, the surface of the roller 4 is initialized.

Due to the friction between the rollers 4 and 5, a charge opposite in polarity to the desired charge of the toner is deposited on each dielectric portion 41 of the roller 4. As a result, closed electric fields, i.e., microfields are formed on the roller 4, as represented by electric lines of force in FIG. 1C. The charges on the dielectric portions 41 will be of the same polarity as the charge on the drum 1 in the case of nonreversal (positive-to-positive) development or of opposite polarity to the latter in the case of reversal (negative-to-positive) development.

On the other hand, since the surface of the roller 5 moves in the same direction as that of the roller 4 at the contact position B, the toner on the roller 5 is rubbed between the rollers 4 and 5. Hence, most of the toner particles on the roller 5 are charged to a desired polarity (opposite to the charge on the drum 1 in the event of nonreversal development or identical with the latter in the event of reversal development). The charged toner on the roller 5 is electrostatically attracted by the microfields of the roller 4 to be thereby deposited on the roller 4 in multiple layers. The roller 4 carrying the sufficiently charged toner in multiple layers leaves the contact position B. It is noteworthy that the embodiment causes the rollers 4 and 5 to move in the same direction at the contact position B and, therefore, prevents the uncharged toner from being fed from the hopper to part of the roller 4 having moved away from the position B despite the rotation of the roller 5. This will be described in detail later. The toner layer on the roller 4 having moved away from the contact position B is leveled by the leveling plate 8 which lightly contacts the roller 4. The resulting toner layer having a uniform thickness is transported to the developing region by the roller 4. In the developing region, while the surface of the roller 4 and that of the drum 1 move at substantially the same speed, the toner is selectively transferred from the roller 4 to the drum 1 to effect contact or noncontact type development. In this region, electric fields are generated which allow the dielectric portions 42 of the roller 4 to exhibit an electrode effect, thereby promoting the transfer of the toner from the roller 4 to the drum 1.

Figure 2:
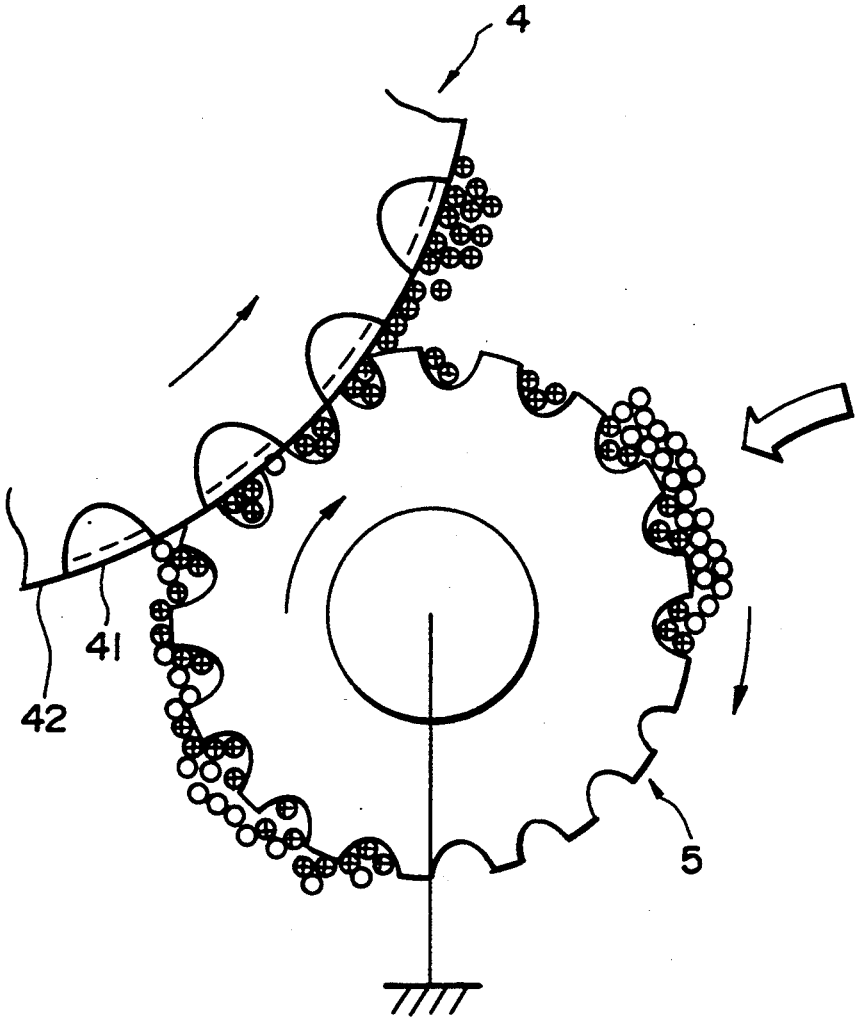
FIG. 2 demonstrates how a toner supply roller also included in the embodiment feeds a toner to the developing roller.
Figure 3:
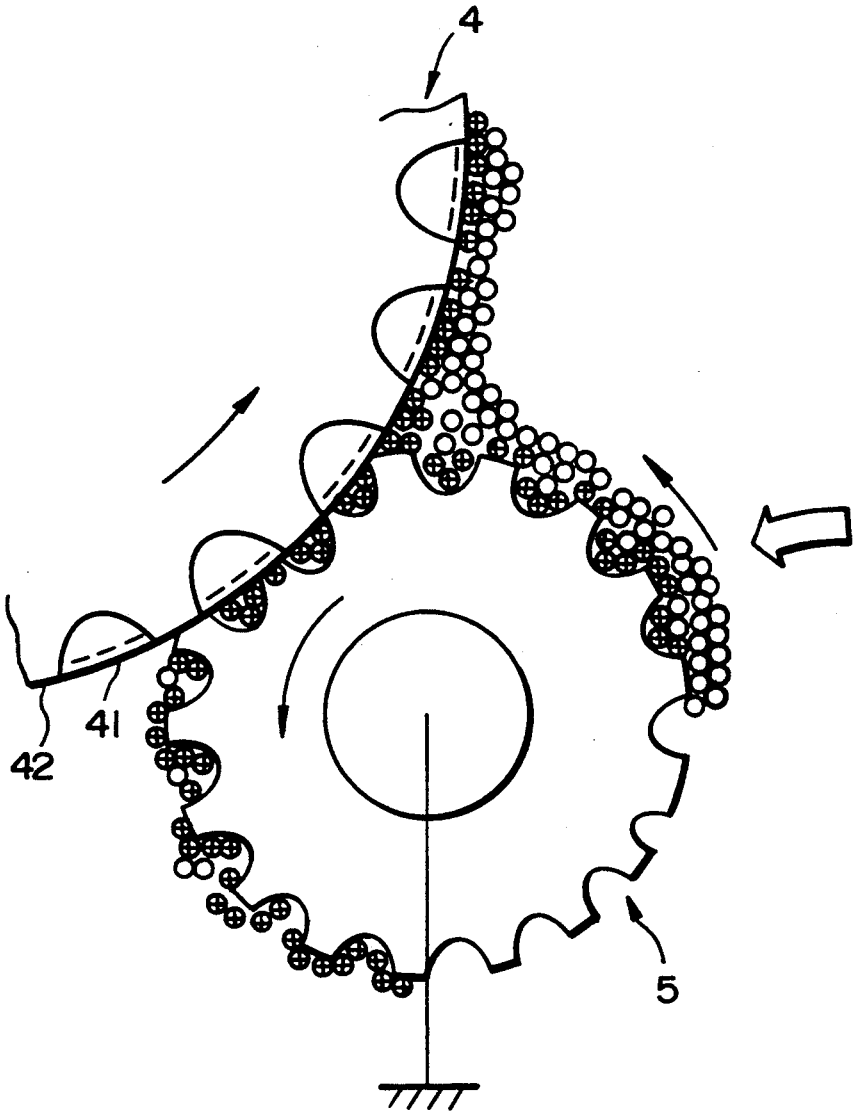
FIG. 3 shows the delivery of the toner to the developing roller by the toner supply roller occurring when the two rollers are rotated in a relation different from the relation of FIG. 1A

Hereinafter will be described how the charge distribution of the toner layer formed on the developing roller 4 is stabilized by the movement of the roller 4 and that of the toner supply roller 5 which occur in the same direction. FIGS. 2 and 3 show respectively the toner deposition on the roller 4 and charge distribution observed when the roller (sponge roller in the embodiment) 5 is moved in the same direction as the roller 4, and the toner deposition and charge distribution observed when the former is moved in the opposite direction to the latter. In the figures, circles indicate uncharged toner particles while circles each containing a symbol "+" indicate charged toner particles.

As shown in FIG. 2, when the rollers 4 and 5 are rotated in the same direction, both the charged toner existing on the roller 5 and the uncharged toner additionally fed from the hopper are transported by the roller 5 to the position where the roller 5 contacts the roller 4. In this position, all the toner particles are charged by the friction between the rollers 4 and 5 and deposited on the roller 4. Since the rollers 4 and 5 move in the same direction at the contact position B, the uncharged toner from the hopper is prevented from reaching part of the roller 4 having moved away from the position B despite the rotation of the roller 5. Hence, the amount of toner deposition on the part of the roller 4 having moved away from the contact position B is determined by the electric fields of the roller 4, the pore ratio of the sponge roller 5 and so forth and, therefore, relatively stable.

As shown in FIG. 3, when the rollers 4 and 5 move in opposite directions at the contact position B, the charged toner existing on the roller 5 and uncharged fresh toner are also transported together to the position B by the roller 5. Assume that the fresh toner from the hopper (an outlined arrow is representative of a toner supply path to the surface of the roller 5) is conveyed to the contact position B while being deposited on the roller 5. Then, a relatively great amount of uncharged toner is transported as far as the inlet side of the contact position B. The toner reached the contact position B and sufficiently charged by the friction between the rollers 4 and 5 is positively deposited on the roller 4 and then brought out of the position B. At the same time, the toner with a short charge is conveyed by the roller 5 to the inlet of the contact position B and then deposited on part of the roller 4 having moved away from the position B. This results from the electrostatic force, i.e., gradient force ascribable to the electric fields on the roller 4 and the cohesion of the toner. The amount of toner deposition on the roller 4 due to the cohesion of the toner and other factors noticeably depends on, among others, the environment. Especially, when microfields are generated on a developing roller, e.g., the developing roller 4 so as to deposit the toner in multiple layers, the amount of deposition of uncharged toner also increases to make the charge distribution of the toner on the roller 4 more unstable.

Figure 4A:
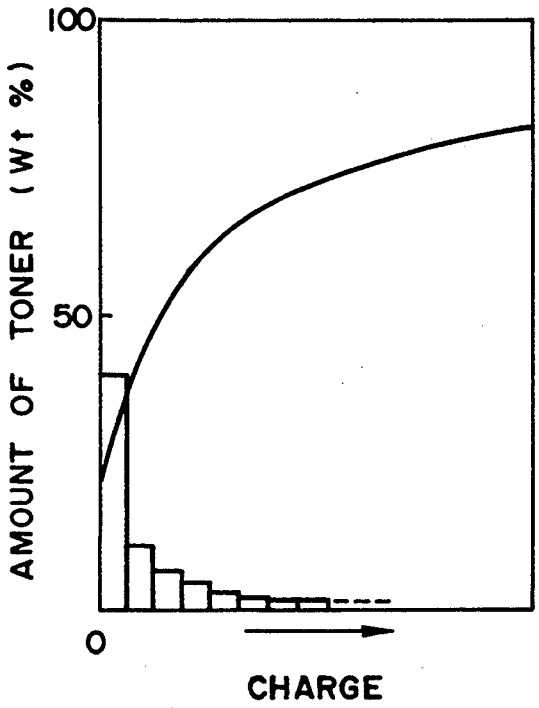
FIG. 4A is a graph representative of a charge distribution of the toner on the developing roller determined when the two rollers are rotated in a relation different from the relation of FIG. 1A.
Figure 4B:
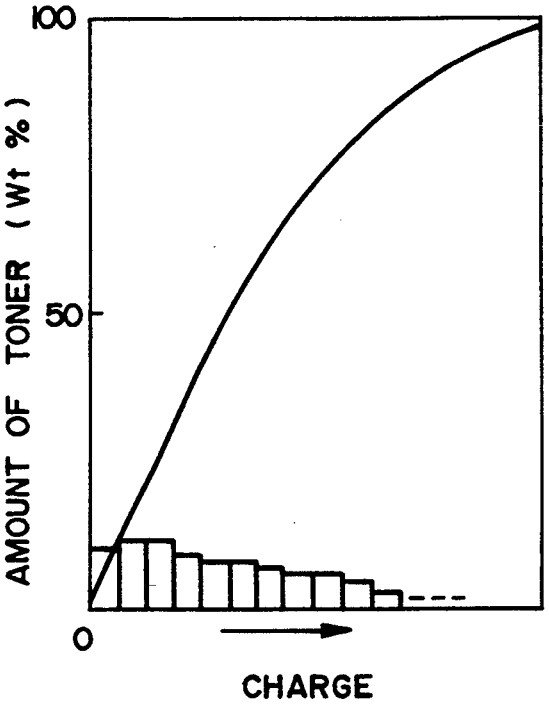
FIG. 4B is a graph representative of a charge distribution of the toner on the developing roller shown in FIG. 1A.
Figure 5:
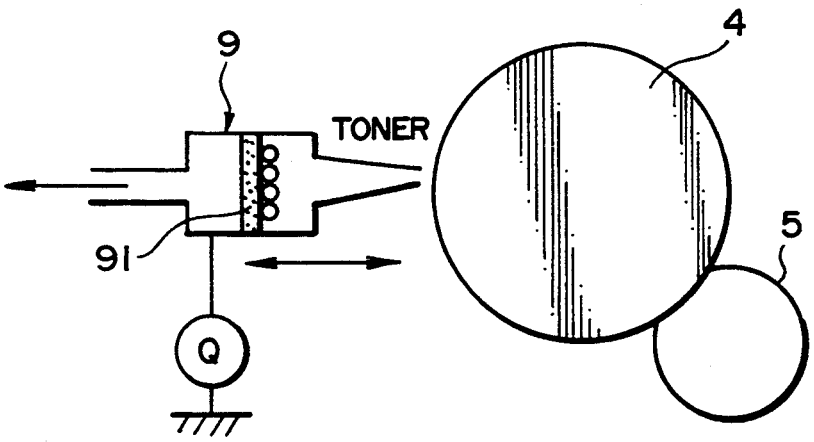
FIG. 5 shows a specific arrangement used to determine the charge distributions.

FIGS. 4A and 4B show respectively a toner charge distribution on the roller 4 particular to the case wherein the rollers 4 and 5 move in opposite directions and a toner charge distribution particular to the case wherein they move in the same direction. FIG. 5 shows a specific arrangement used to determine the relations plotted in FIGS. 4A and 4B. As shown in FIG. 5, a suction nozzle 9 repetitively sucked, or sampled, the toner carried on the roller 4 with the distance thereof to the roller 4 sequentially changed. A filter 91 was accommodated in the suction nozzle 9 to catch the toner. The amount of charge and the amount of deposition of the toner caught by the filer 91 were determined at each sampling. As FIGS. 4A and 4B indicate, the amount of uncharged toner increases when the rollers 4 and 5 move in opposite directions (FIG. 4A), but it sharply decreases when the rollers 4 and 5 move in the same direction (FIG. 4B).

As stated above, when the rollers 4 and 5 move in the same direction at the contact position B, the amount of toner deposition on the roller 4 is sparingly affected by changes in ambient conditions and, in addition, the amount of uncharged toner is small. This is successful in stabilizing the developing characteristic of the device.

In the illustrative embodiment, the rollers 4 and 5 are rotated counterclockwise and clockwise, respectively, so as to move in the same direction at the contact position B, as shown in FIG. 1A. Alternatively, the rollers 4 and 5 may be rotated clockwise and counter clockwise, respectively, in which case the drum 1 will be rotated counterclockwise for effecting the previously stated equispeed development.

The embodiment shown and described has various advantages, as follows. The developing roller 4 has the minute dielectric portions 41 and the minute conductive portions 42 connected to ground and distributed on the surface of the roller 4 together with the dielectric portions 41. The toner supply roller 5 charges the dielectric portions 41 by friction to thereby generate numerous microfields. As a result, sufficiently charged toner particles are easily deposited on the roller 4 in a great amount and in multiple layers.

Since the rollers 4 and 5 move in the same direction at the contact position B, uncharged toner particles in the hopper are prevented from reaching part of the roller 4 having moved away from the position B despite the rotation of the roller 5. Hence, the amount of toner deposition on the roller 4 is sparingly affected by changes in ambient conditions and, in addition, the amount of uncharged toner is small. This is successful in stabilizing the developing characteristic. It follows that a sufficiently charged toner with a minimum of uncharged particles can be stably deposited in multiple layers on the roller 4, implementing equispeed development.

Since an extra blade or similar implementation for removing uncharged toner particles from the upper layer formed on the roller 4 is not necessary, the developing device is simple in construction.

Even when the leveling plate 8 is used to produce a smooth image, it has only to be pressed against the roller 4 at a lower pressure than the conventional blade. Therefore, the material of the leveling plate 8 is not limited to, for example, conventional PFA having high separability. Specifically, the plate 8 may even be made of polyurethane rubber, fluoric rubber, silicone rubber or similar elastic rubber or SUS or similar metal. In fact, when use was made of a metal blade usually producing vertical stripes in an image on approximately the 1,000th copy of A4 size due to the adhesion of toner, the embodiment provided even the 20,000th copy with image quality comparable with initial one since the pressure exerted by the plate 8 on the roller 4 was relatively low.

Since the roller 4 moves at substantially the same speed as the drum 1 in the developing region, the toner is prevented from increasing at the rear edge portion of an image. Hence, even a color image is tree from excessive density or misregistration of colors at the rear edge portion thereof.

The toner layer formed on the roller 4 does not include uncharged particles. This insures desirable image quality by eliminating the contamination of the background and the fall of resolution.

The leveling plate 8 lightly presses against part of the roller 4 having moved away from the contact portion B so as to uniformize the thickness of the toner layer to be transported to the developing region. Hence, the resulting toner image, especially solid toner image, has a uniform density distribution. In the illustrative embodiment, it is likely that the amount of toner deposition on the roller becomes slightly irregular due to the dielectric portions and conductive portions 42 arranged together on the surface of the roller 4. The plate 8 successfully eliminate the degradation image quality ascribable to such an irregularity.

Specific configurations available with the embodiment will be described hereinafter.

(1) Developing roller 4: A metallic core in the form of a roller having a diameter of 25 mm was knurled to form 0.1 mm thick and 0.13 mm wide grooves in a cross-hatch pattern at a pitch of 0.3 mm and at an angle of 45°. The surface of such a roller was coated with fluoric resin (Lumifron available from Asahi Glass (Japan)) and then dried at 100° C. for about 30 minutes to form a dielectric coating. The resulting surface of the roller was machined to expose the metallic core as the conductive portions 42. As a result, the resin filling the grooves appeared as the dielectric portions 41. The conductive portions 42 and the dielectric portions 41 occupied respectively 36% and 64% of the entire surface of the roller. The surface roughness R should be about 3 μm to 20 μm, preferably 5 μm to 10 μm.

(2) Toner supply roller 5: A sponge roller having a volume resistance of $10^6$ Ωcm and a diameter of 14 mm was produced by the impregnation of foam polyurethane carbon. The sponge roller was pressed against the developing roller 4 to a depth of 1 mm. A predetermined bias was applied to the metallic core of the sponge roller.

(3) Casing 3: A bias which was the bias (DC component) to the toner supply roller 5 plus 100 V to 200 V was applied to the casing 3.

(4) Leveling plate 8: A 2 mm thick elastic plate made of urethane was pressed against the developing roller 4 at a pressure of 10 g/cm to 20 g/cm.

(5) Bias and gap for development: An AC bias of 1000 Vp-p (peak-to-peak) and 250 Hz on which DC −500 V was superposed was applied to the developing roller 4 (or −50 V to 150 V DC bias, if desired). The gap for development was selected to be 150 μm.

(6) Photoconductor: Use was made of OPC (Organic Photo Conductor). The photoconductor was uniformly charged to a potential of −900 V.

(7) Toner: A positively chargeable, styrene-acryl-based toner was used and contained negrosine as a polarity control agent. 0.5 wt % of $SiO_2$ particles were applied to the outside of the toner.

Under the above conditions, a toner layer formed on the developing roller 4 was found to deposit in an amount of 1.0 mg/cm$^2$, have a mean charge of 5 μc/g to 8 μc/g, and contain only a small amount of uncharged toner.

Contact type development with a gap of 0 mm was performed under the above conditions except that the bias for development was an AC bias of 500 Vp-p and 250 Hz on which DC −250 V was superposed (or −100 V to 250 V DC bias, if desired). The resulting toner layer on the developing roller 4 was found to be as desirable as the toner layer formed by the above conditions. In the case of contact type development, it is preferable to use a photoconductive element in the form of a belt or an elastic roller having a rubber or similar elastic layer thereon.

In the above specific configuration, a positively charged toner is deposited on the negatively charged photoconductor to effect nonreversal development. Alternatively, use may be made of a negatively chargeable toner, or reversal development may be effected.

Generally, the toner is basically made of polyester, acryl, polystyrene, epoxy, phenol or similar resin. The composition of the toner will not be described specifically since the polarity and the amount of charge can be controlled by a polarity control agent, as well known in the art.

While various materials are available for the constituents of the developing device, only the materials desirable in respect of the separability from the toner, durability and so forth are listed in Table 1 below.

TABLE 1

| | TONAR POLARITY TONER | |
|---|---|---|
| PART | POSITIVE CHARGE TONER | NEGATIVE CHARGE TONER |
| DIELECTRIC BODY OF DEVELOP ROLLER | fluoric resins<br>PFA (tetrafluoroethyrene-per-fluoroalkylvinylether copolymer)<br>FEP (tetrafluoroethyrene-hexa-fluoropropyrene copolymer)<br>silicon resins<br>olefin resins<br>PE (polyethyrene),<br>PP (polypropyrene), etc.<br>polymers containing low molecular charge control agent, e.g., electron accepting dye | Nylon resins<br>6 Nylon, 11 Nylon,<br>12 Nylon, etc.<br>acryl resins<br>PMMA, etc.<br>degeneration silicone resins<br>epoxy degeneration, acryl degeneration, etc.<br>polymers containing low molecular charge control agent, e.g., electron accepting dye |

TABLE 1-continued

| PART | TONAR POLARITY TONER | |
|---|---|---|
| | POSITIVE CHARGE TONER | NEGATIVE CHARGE TONER |
| TONER SUPPLY ROLLER | sponge or fur brush of urethane or styrene having resistance lower than semiconduction and weather-resisting EPDM (ethyrenepropyrene dye material), silicone rubber, etc. | sponge or fur brush of urethane or styrene having resistance lower than semiconduction and weather-resisting |
| LEVEL PLATE | elastic member which can be pressed and preferably positively charges toner with a portion contacting develop roller like dielectric body | elastic member which can be pressed and preferably negatively charges toner with a portion contacting develop roller like dielectric body |

In the illustrative embodiment, the toner supply roller 5 is rotated to transport the toner toward the developing roller 4 at a position where it faces the inner periphery of the lower wall of the casing 3. This, coupled with the fact that a gap exists between the roller 5 and the lower wall of the casing 3, is apt to cause the toner to leak via the opening of the casing 3 by way of the gap between the roller 4 and the inner periphery of the lower wall of the casing 3 beneath the roller 4, depending on, for example, the configuration of the hopper. FIGS. 6–9 show specific arrangements for preventing the toner from leaking via the opening of the casing 3. As shown, the inner periphery of the casing 3 beneath the toner supply roller is configured to contact the roller 5 over a range extending from the vicinity of a position A where the agitator 6 feeds the toner to the vicinity of the contact position B. In such a configuration, the roller 5 carrying the toner fed thereto at the position A transports it while contacting the inner periphery of the casing 3. This eliminates the gap between the roller 5 and the casing 3 which would otherwise allow the toner to accumulate. Hence, the roller 5 is prevented from driving an excessive amount of toner to below the roller 4 despite the rotation thereof. It follows that an excessive amount of toner is prevented from being pushed into the gap between the roller 4 and the casing 3 and leaking through the opening of the casing 3.

Figure 7:
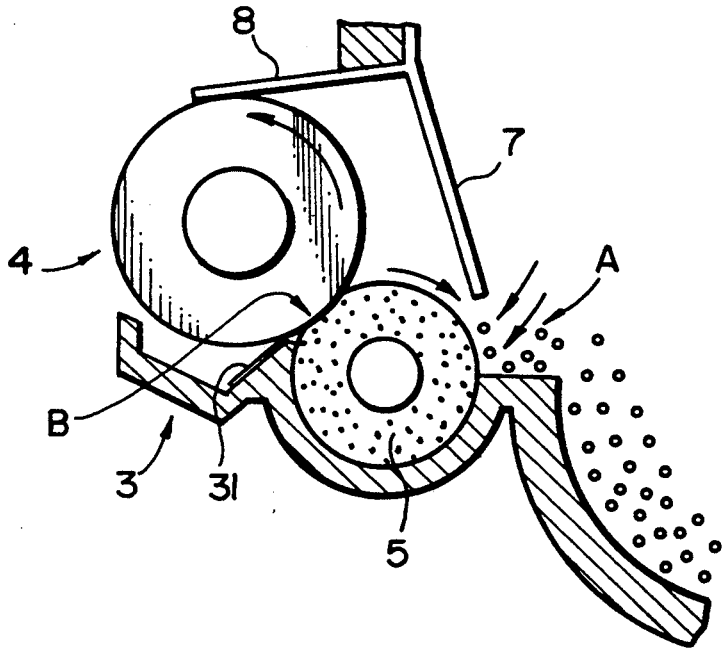
Figure 8:
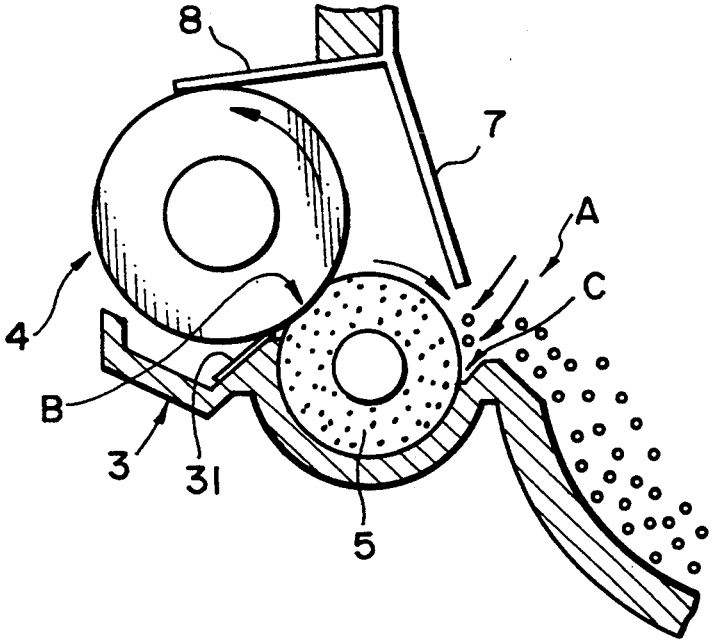
Figure 9:
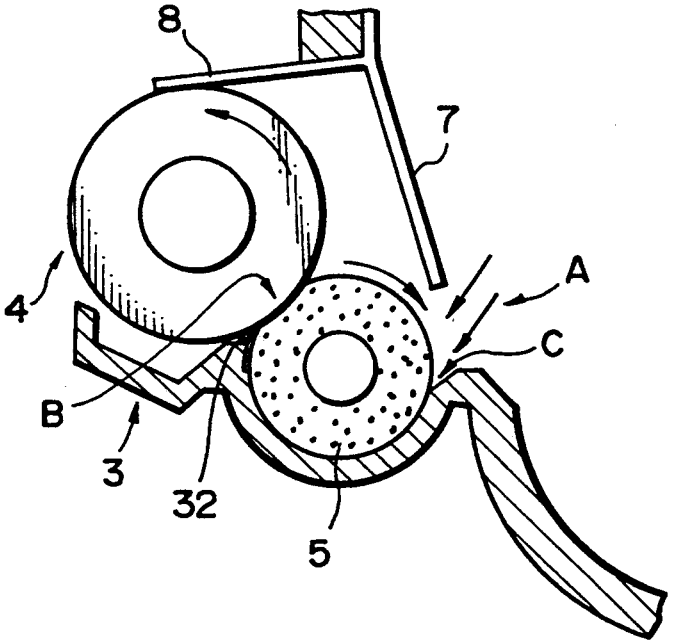

Further, in each of the specific configurations shown in FIGS. 7–9, a seal member 31 or 32 made of rubber or implemented as a film is affixed at the lower edge thereof to the lower wall of the casing 3. The seal member 31 or 32 is held in contact with part of the roller 4 and/or the roller 5 adjoining the contact position B. The seal member 31 or 32 prevents the toner being transported by the roller 5 from reaching the gap between the roller 4 and the casing 3, thereby further enhancing the effect achievable with the unique configuration of the casing 3. Specifically, in FIGS. 7 and 8, the seal member 31 extends along the periphery of the roller 4 from the casing 3. In FIG. 9, the seal member 32 extends along the periphery of the roller 5. Further, the free edge of the seal member 31 or 32 may contact part of the roller 4 adjoining the contact position B, as shown in FIG. 7 or 8, or may be held between the rollers 4 and 5, as shown in FIG. 9.

Figure 6:
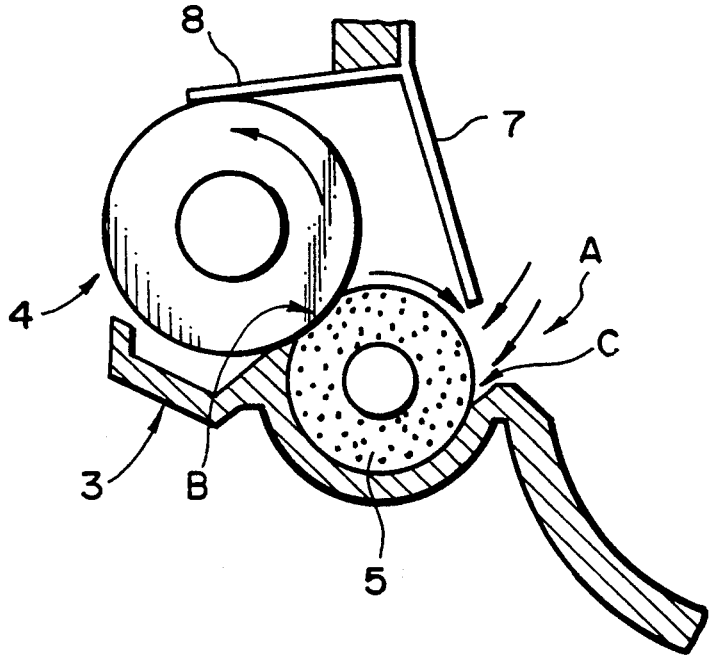
FIGS. 6–9 are sections each showing a specific modified form of a casing included in the embodiment.

In the configurations shown in FIGS. 6, 8 and 9, the inner periphery of the casing 3 adjoining the toner supply position A is shaped such that the roller 5 and the casing 3 are spaced apart by a wedge-shaped clearance C which is tapered toward the downstream side with respect to the direction of movement of the roller 5. Such a clearance C causes the toner fed to the inlet side thereof by the agitator 6 to enter smoothly into the interface between the roller 5 and the casing 3 due to the rotation of the roller 5, thereby insuring stable supply of the toner to the roller 5. To allow the toner from the hopper to easily enter the clearance C, the inlet side of the clearance C should preferably be oriented upward, as illustrated.

When the inner periphery of the casing 3 beneath the roller 5 is provided with the configuration shown in any one of FIGS. 6–9, it is preferable that the roller 5 be rotated at a peripheral speed which is about 1.0 to 1.5 times as high as the peripheral speed of the roller 4. Should the former be not 1.0 time as high as the latter, the toner on the roller 4 would be scraped off by the roller 5 to accumulate on the inner periphery of the casing 3 below the roller 4. Such a toner is apt to leak through the opening of the casing 3. On the other hand, even when the former is more than 1.5 times as high as the latter, the amount of toner supply to the roller 4 does not increase beyond one obtainable with 1.5 times; rather, this simply increases the torque for driving the roller 5.

Figure 10:
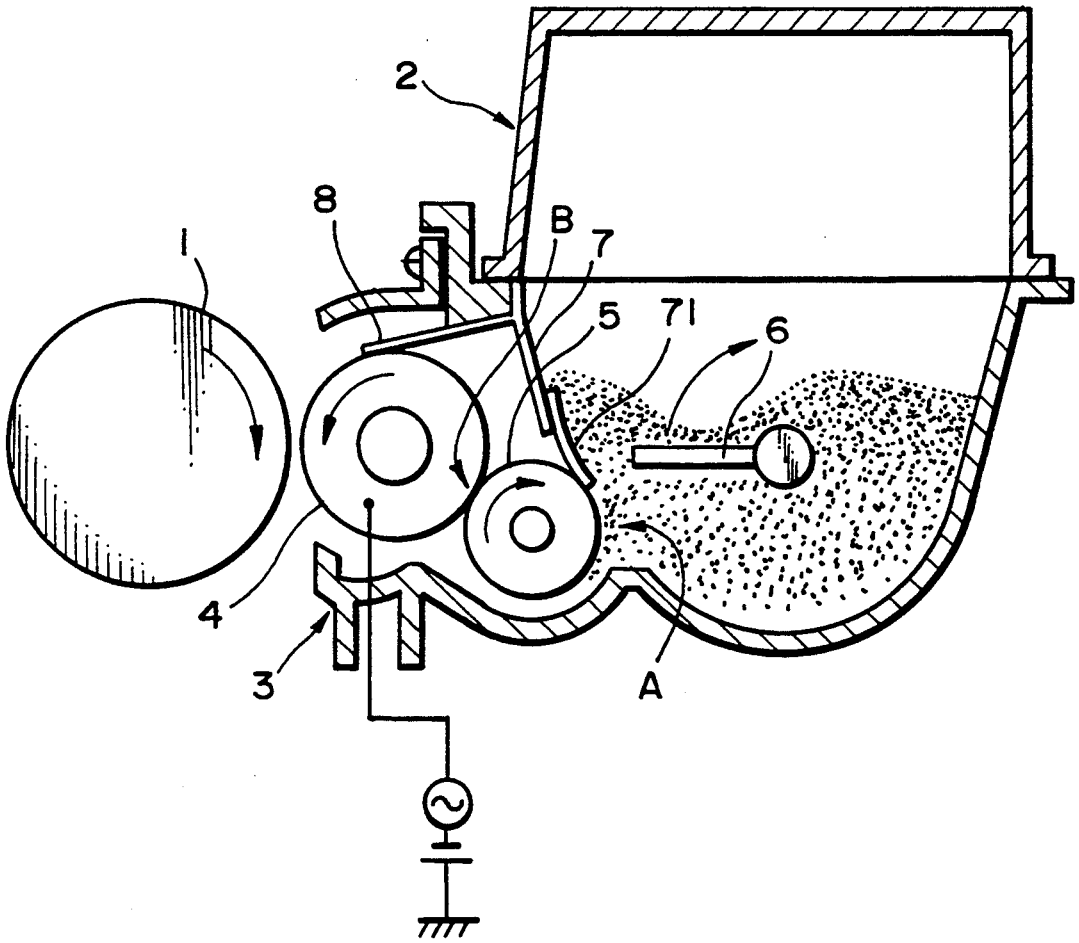
FIGS. 10, 11A and 11B, and 12A and 12B are sections each showing a specific modified form of a wall playing the role of a regulating member.

In FIG. 1A, the wall, or regulating member, 7 is positioned such that the lower edge thereof adjoins the surface of the roller 5. As shown in FIG. 10, an auxiliary seal member 71 may be affixed to the lower edge of the wall 7 such that the lower edge thereof contacts the roller 5, if desired. The seal member 71 may be implemented as an about 1 mm thick elastic plate made of urethane rubber and having a hardness of about 30 to about 80. In a specific configuration, the lower edge of the wall 7 is located at a distance of about 1 mm to about 5 mm from the roller 5, and the lower edge of the seal member 71 is elastically pressed against the roller 5 at a pressure of about 0 g/cm to about 50 g/cm. This is successful in preventing the uncharged toner from the hopper from reaching the roller 4 without obstructing the transport of the toner toward the hopper by the roller 5.

Figure 11A:
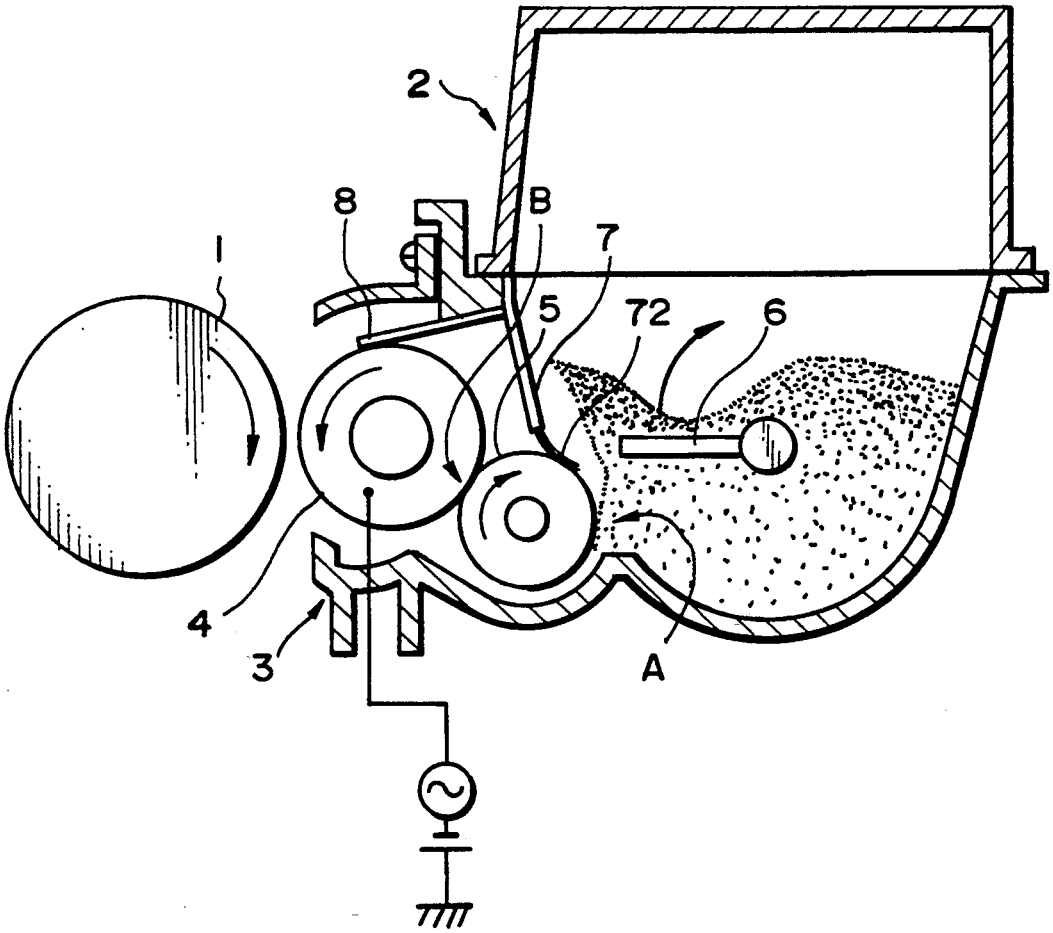
Figure 11B:
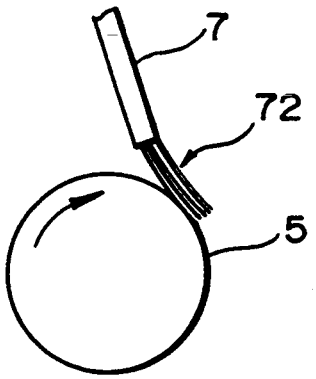

As shown in FIGS. 11A and 11B, the seal member 71 may be replaced with a brush 72 made of Nylon (trade name), acryl or similar region.

Figure 12A:
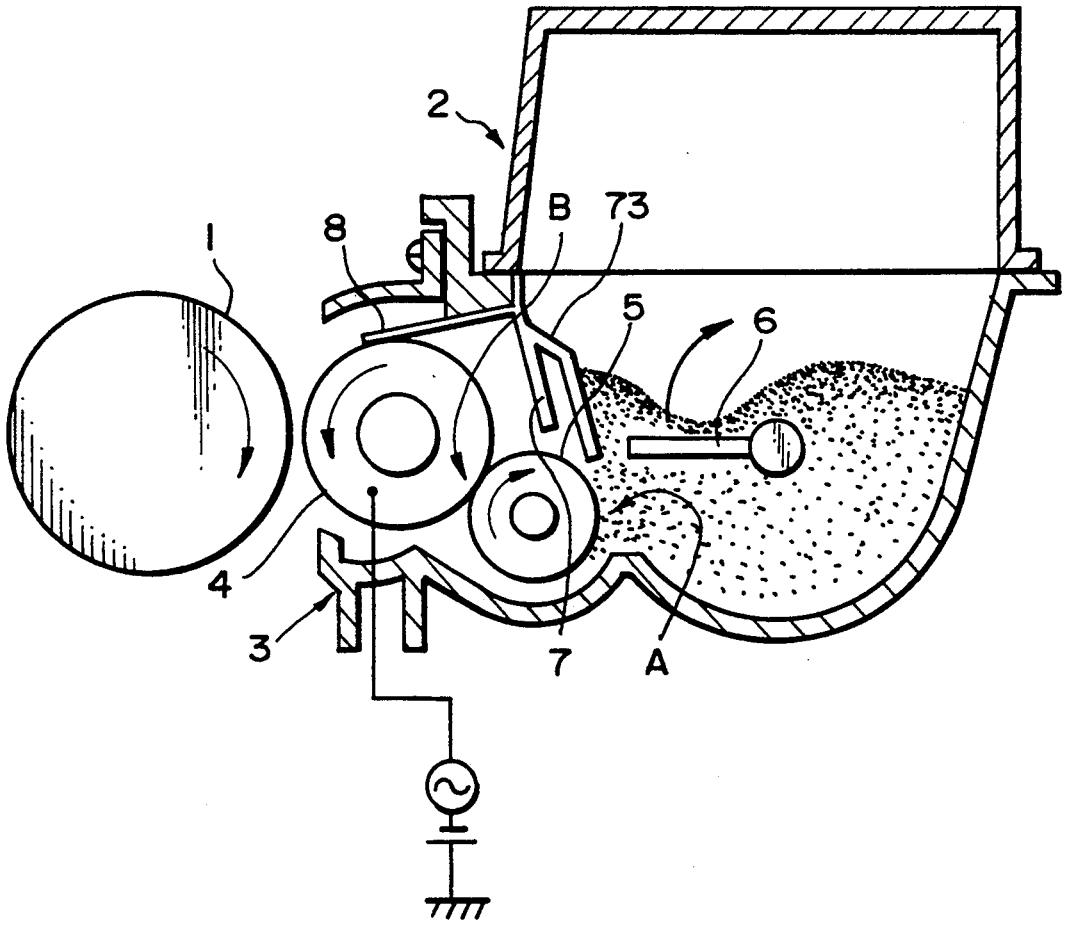
Figure 12B:
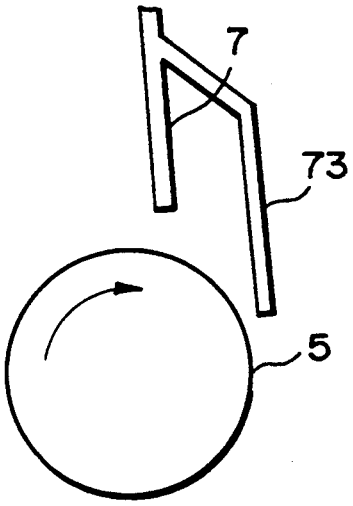

Further, as shown in FIGS. 12A and 12B, an auxiliary seal member 73 may extend from the wall 7 toward the hopper (downstream of the wall 7 with respect to the direction of rotation of the roller 5) and face the roller 5. Specifically, the seal member 73 faces the roller 5 at a level lower than the lower edge of the wall 7 and at a distance of 1 mm to 5 mm from the roller 5. If desired, the seal member 73 may be implemented as a member physically independent of the wall 7 and affixed to the casing 3.

Figure 13:
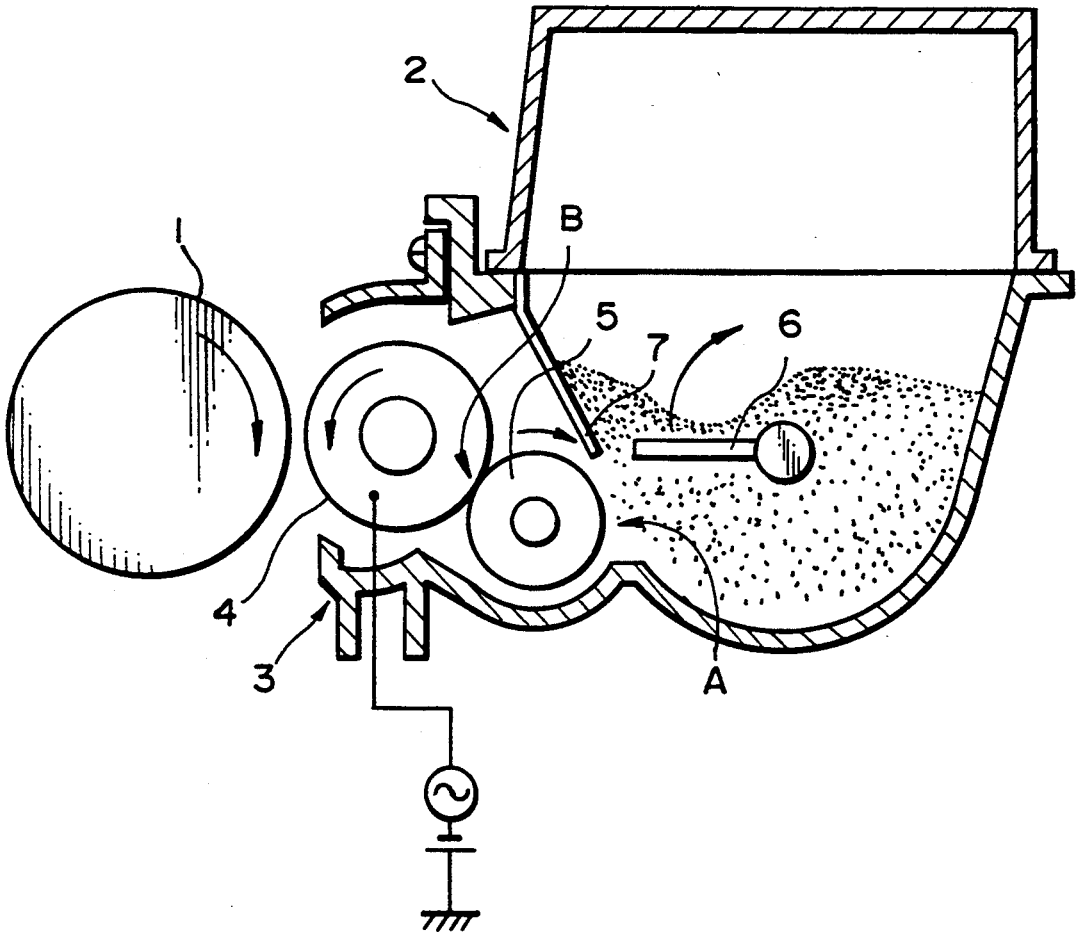
FIGS. 13 and 14 are sections each showing a specific modification of the embodiment which lacks a leveling plate.
Figure 14:
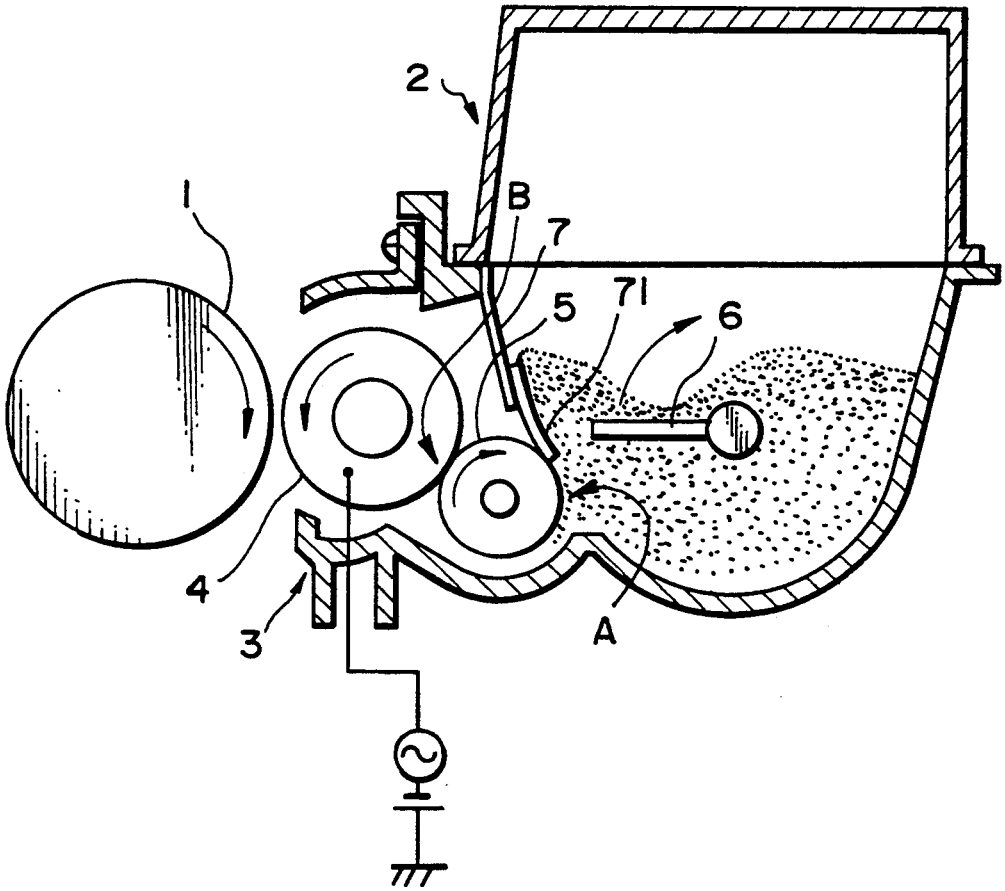
Figure 16A:
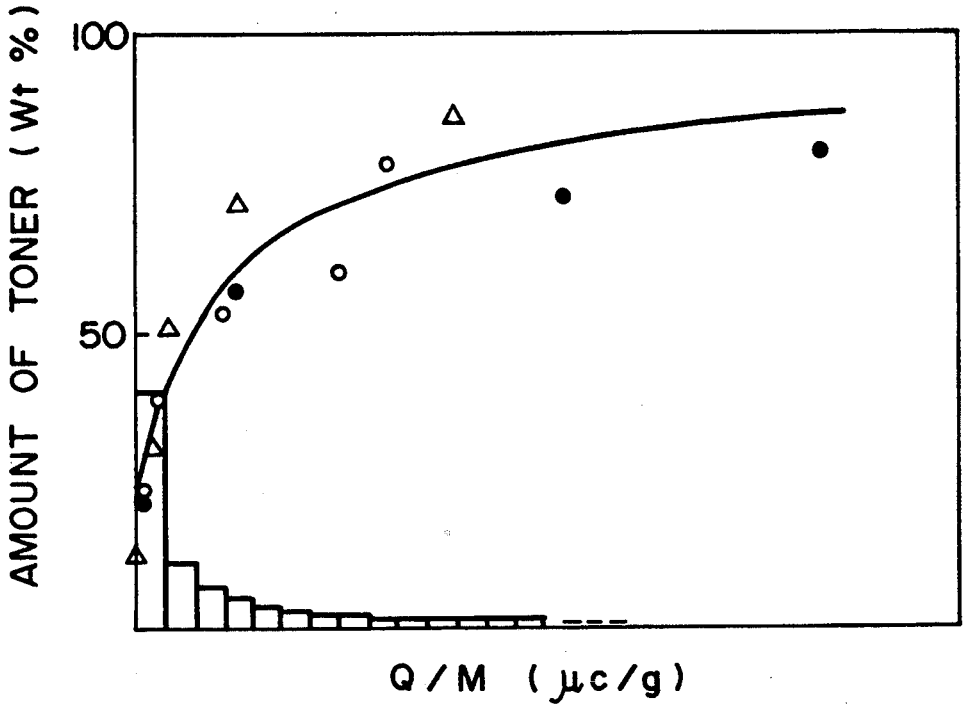
FIG. 16A is a graph representative of a charge distribution of the toner on the developing roller determined when the toner supply roller and developing roller of the modification lacking the leveling plate were moved in opposite directions in a contact position.
Figure 16B:
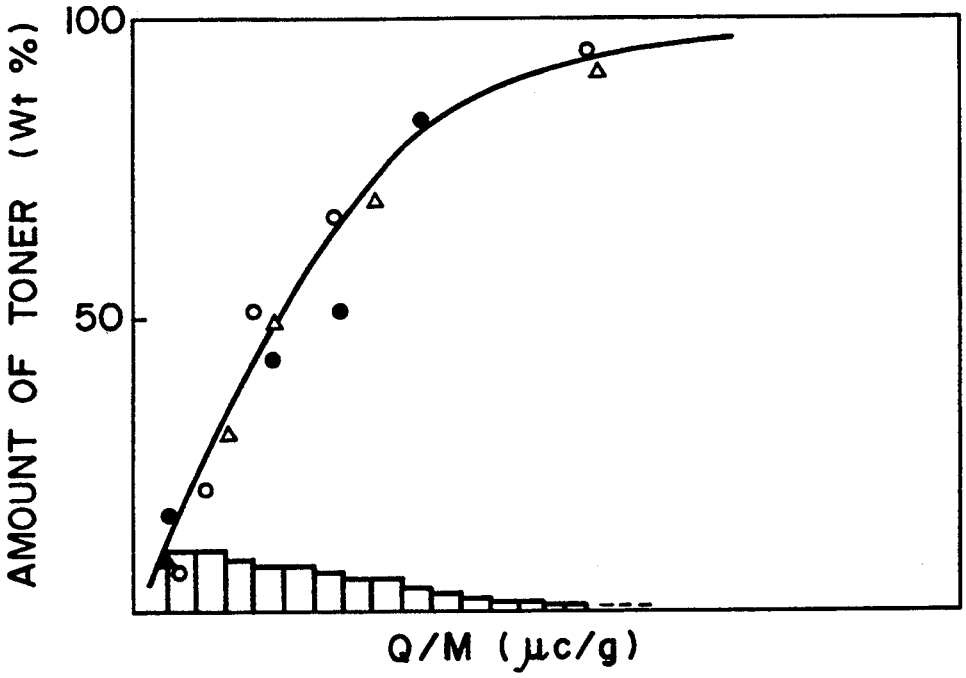
FIG. 16B is a graph similar to FIG. 16A, showing a charge distribution determined when the two rollers are moved in the same direction at the contact position.
Figure 17A:
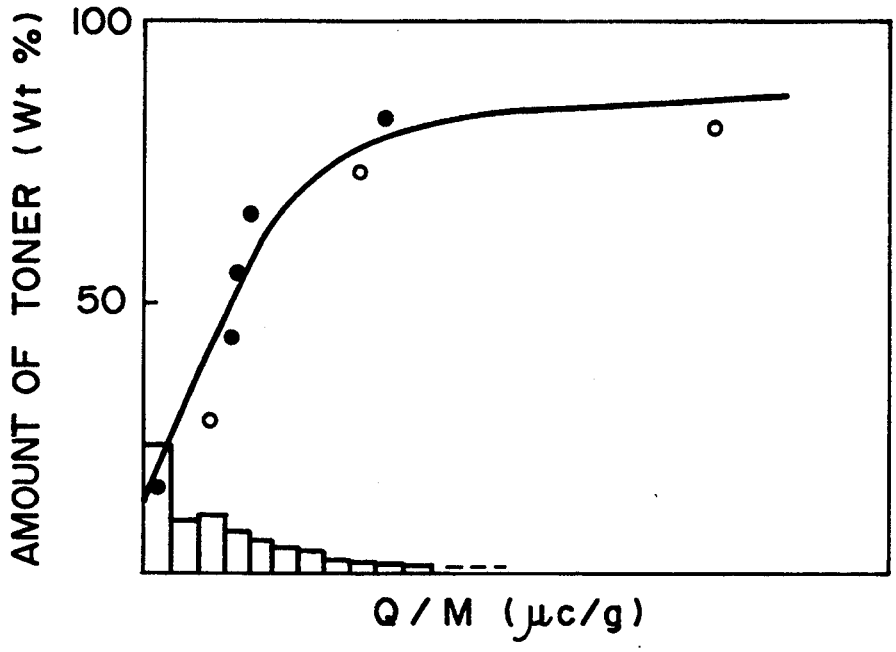
FIG. 17A is a graph representative of a charge distribution of the toner on the developing roller determined when the two rollers of the modification including the leveling plate were moved in opposite directions.
Figure 17B:
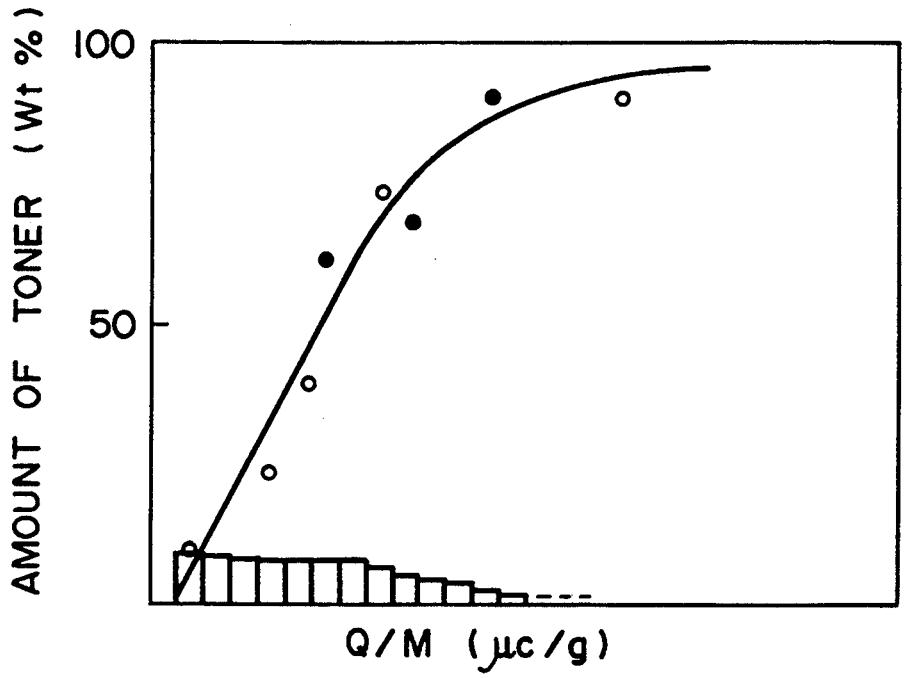
FIG. 17B is a graph similar to FIG. 17A showing a charge distribution determined when the two rollers are moved in the same direction.

The leveling plate 8, FIG. 1A, is omissible, as stated earlier. FIGS. 13 and 14 each shows a specific arrangement lacking the leveling plate 8. FIGS. 16A and 16B plot respectively a charge distribution of a toner layer formed on the roller 4 observed when the roller 5 is moved in the opposite direction to the roller 4 at the contact position B, and a charge distribution observed when the former is moved in the same direction as the latter, each in an arrangement void of the leveling plate 8. FIGS. 17A and 17B correspond to FIGS. 16A and 17B except that they pertain to the arrangement including the leveling plate 8. As these figures indicate, the amount of uncharged toner is far smaller when the roller 5 is moved in the same direction as the roller 4 at the contact position B than when the former is moved in the opposite direction to the latter, with no regard to the presence/absence of the plate 8.

However, the leveling plate is desirable to eliminate the fall of image quality due to the irregular toner deposition on the roller 4. Further, the leveling plate 8 should preferably be capable of forming a stable toner layer on the roller 4 with no regard to changes in ambient conditions, as follows.

When the roller 5 is moved in the same direction as the roller 4 at the contact position B, an extra blade or similar implementation is not necessary, i.e., the leveling plate 8 should only be pressed at a low pressure against the roller 4, as stated earlier. However, in a relatively dry environment, e.g., 10° C. and 15% RH, the amount of charge deposited on the toner increases and strongly adheres to the surface of the roller 4 compared to an ordinary humidity environment. As a result, a greater amount of toner is fed to the roller 4. As the amount of toner on the roller 4 exceeds the upper limit (e.g. 2.0 $mg/cm^2$) of an adequate range, the background is contaminated, and the resolution decreases with no regard to the amount of charge of the toner. In the illustrative embodiment, since only the toner sufficiently charged by the roller 5 is fed to the roller 4, the absolute amount in which the toner is fed to the roller 4 by the roller 5 is relatively small. Hence, the probability that the toner on the roller 4 exceeds the upper limit is low despite that the pressure exerted by the leveling plate 8 is low. However, considering the fact that the amount of toner on the roller 4 is susceptible to the environment, it is preferable to use the leveling plate 8.

A reference will be made to FIGS. 15–18 for describing a specific configuration of the leveling plate capable of forming a stable toner layer with no regard to the environment.

Figure 15:
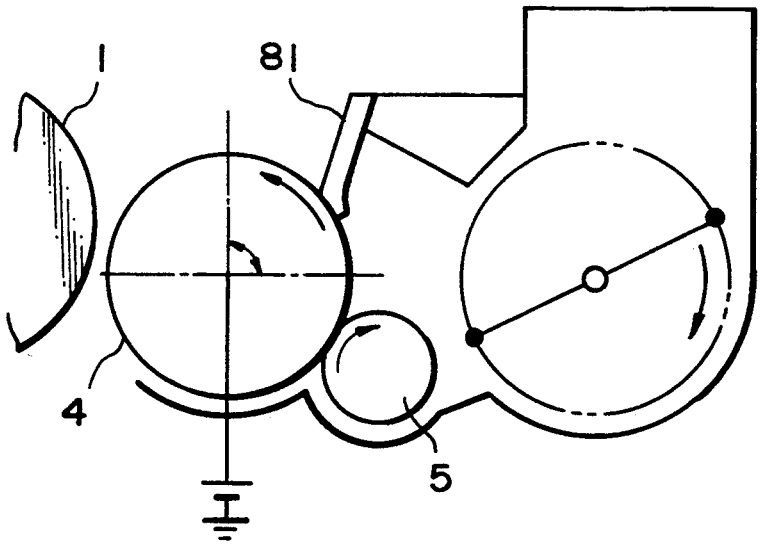
FIG. 15 is a section showing a modification of the leveling plate.
Figure 18:
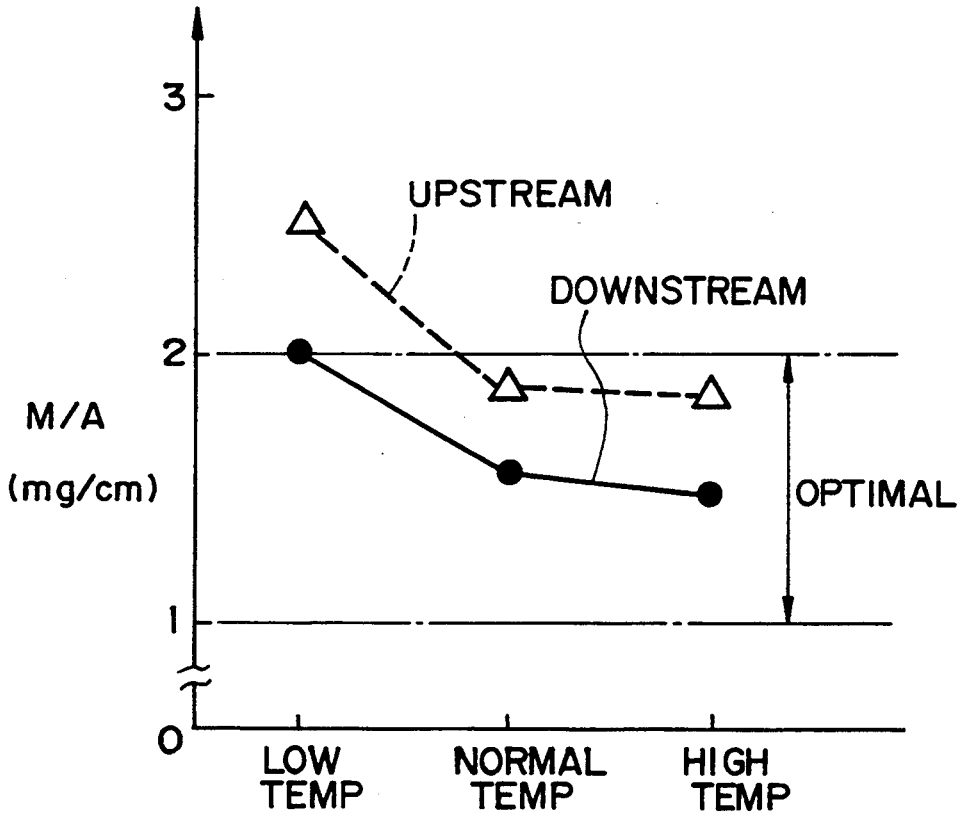
FIG. 18 is a graph indicative of a relation between humidity and the amount of toner charge.

In FIG. 15, assume a horizontal line and a vertical line extending through the center of the roller 4, and a first quadrant defined by such lines and which is the upper quadrant close to the hopper. Then, a leveling plate 81 is positioned such that the free edge thereof contacts the surface of the roller 4 located in the first quadrant. The upper edge of the plate 81 is affixed to, for example, the casing 3 at the downstream side of the lower edge with respect to the direction of rotation of the roller 4. As shown in FIG. 18, this configuration maintains the change in the amount of toner to deposit on the roller 4 and ascribable to the environment smaller than the configuration wherein the upper edge of the plate 18 is affixed to, for example, the casing 3 at the upstream side of the lower or free edge. This is because the regulating force against the change in the amount of toner reaching the position where the blade 81 contacts the roller 4 is enhanced. In fact, with the leveling plate 81 made of SUS, it was found that a toner deposits in a range of from 1.0 $mg/cm^2$ to 2.0 $mg/cm^2$ and forms a stable layer with a mean charge of 5 $\mu c/g$ to 8 $\mu c/g$ and containing a minimum of uncharged toner, despite changes in environment.

Figure 19:
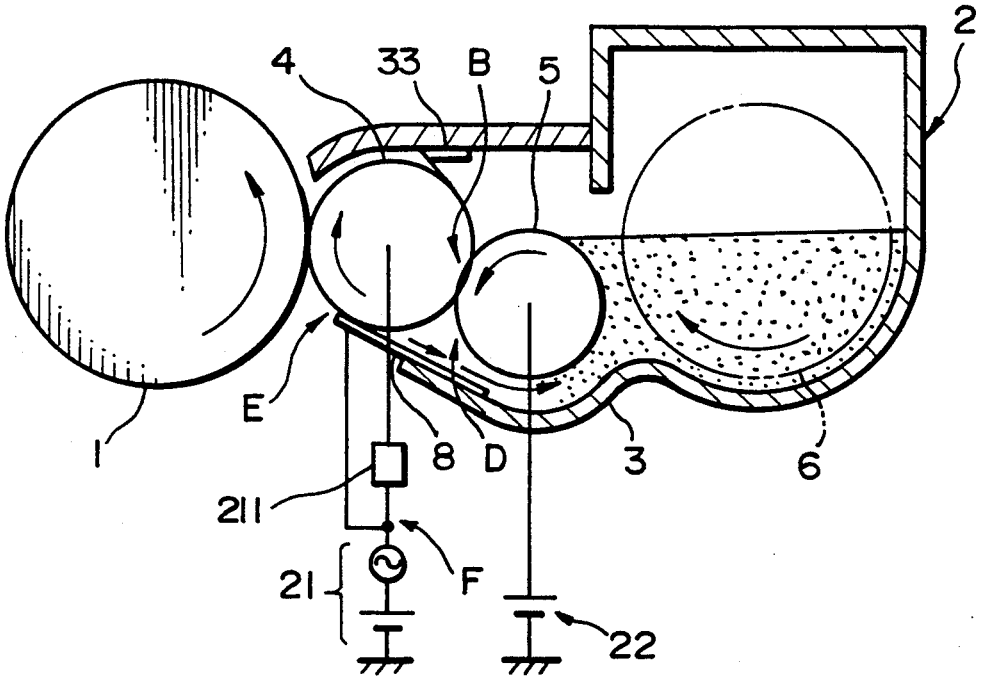
FIG. 19 is a section showing a developing device wherein the developing roller and the toner supply roller are rotated clockwise and counterclockwise, respectively.
Figure 20:
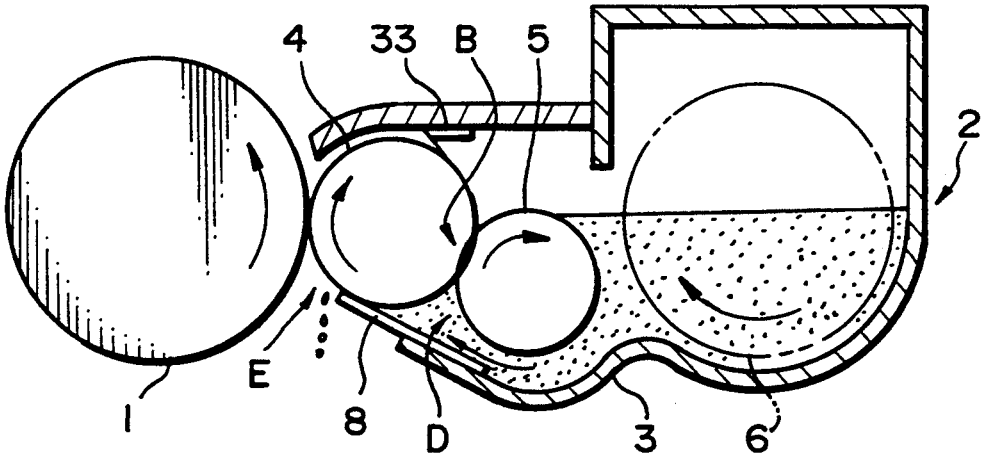
FIG. 20 is a section of a developing device wherein the two rollers both are rotated clockwise.
Figure 21:
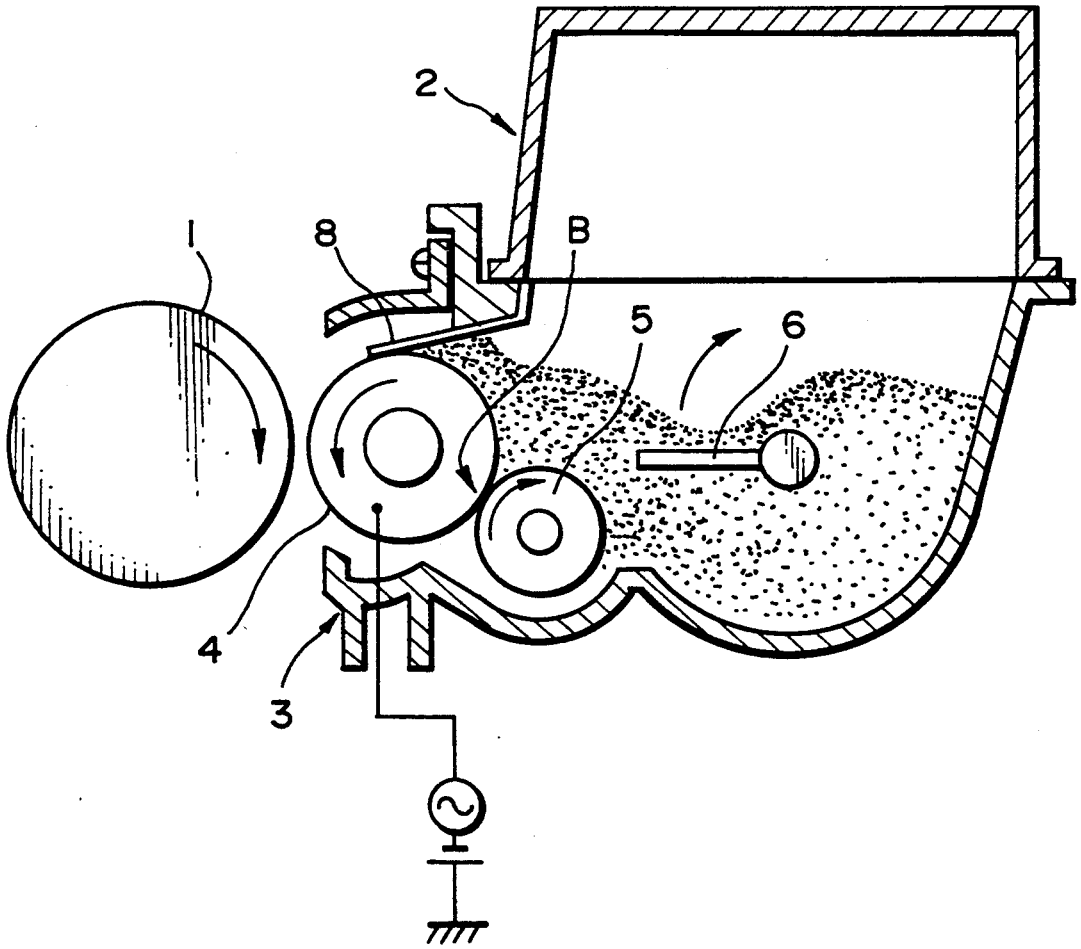
FIG. 21 is a section of a developing device lacking the wall.
Figure 22:
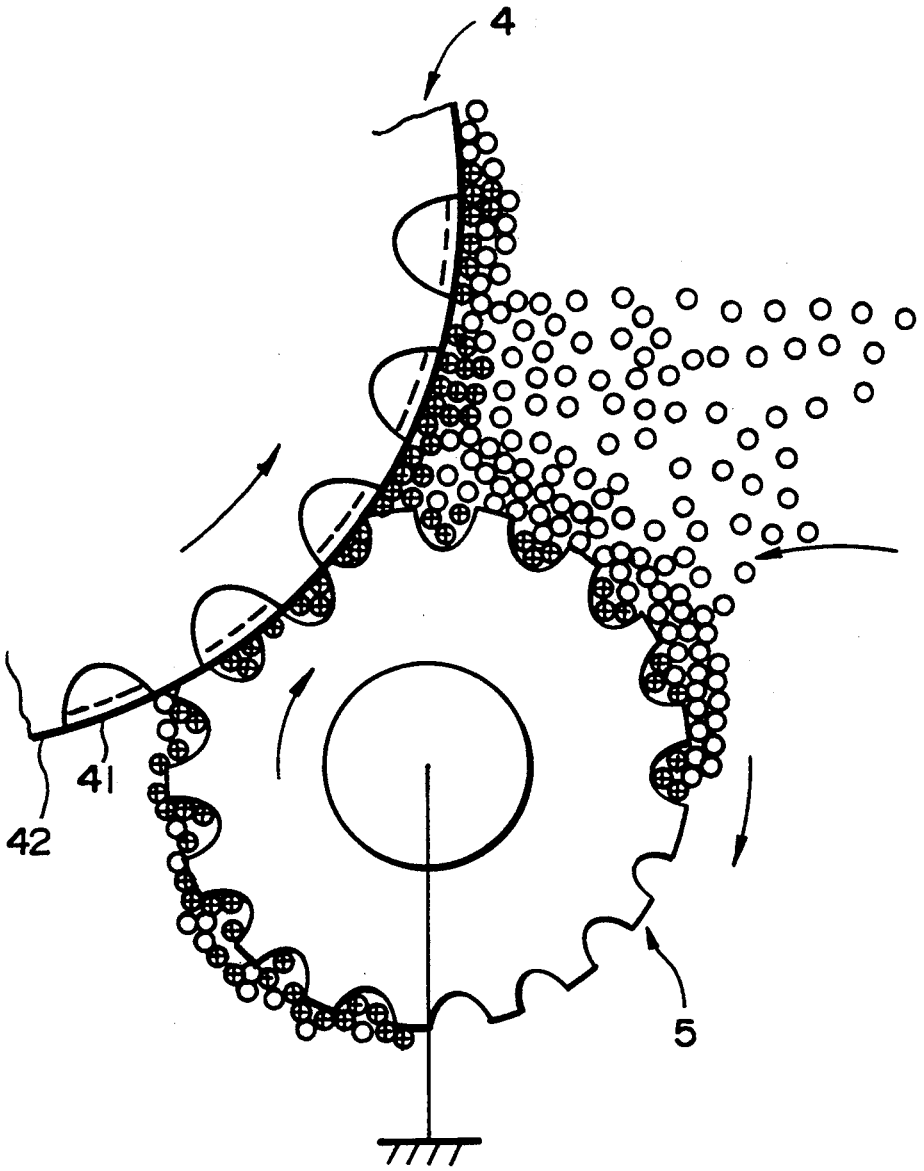
FIG. 22 is a section showing the supply of the toner to the developing roller in the device of FIG. 21.

While the roller 4 shown in FIG. 1A is rotated counterclockwise, it may be rotated clockwise, as shown in FIG. 19. In such a case, assume that the roller 5 is rotated clockwise, i.e., it is moved in the opposite direction to the roller 4 at the contact position B. Then, there arises a problem that the toner scraped off from the roller 4 by the leveling plate 8 and the toner transported by the roller 5 sequentially accumulate in a space D beneath the roller 4. This part of the toner finally drops from the free edge E of the plate 8 and fails to form a desirable toner layer on the roller 4. In the light of this, the developing device 2 shown in FIG. 19 rotates the roller 5 counterclockwise such that it moves in the same direction as the roller 4 at the contact position B. In addition, the plate 8 is located such that the free edge thereof contacts the roller 4 at the downstream side of the contact portion B with respect to the direction of rotation of the roller 4. The other edge of the plate 8 is affixed to, for example, the casing 3.

In the above construction, the toner scraped of from the roller 4 by the leveling plate 8 and the toner transported by the roller 5 flow in a direction indicated by arrows without staying in the space D, i.e., it is recirculated to the hopper. Hence, despite that the roller 4 is rotated clockwise, the toner is prevented from dropping from the edge E of the plate 8. This allows the toner to form multiple layers on the roller 4 more stably.

In the device 2 shown in FIG. 19, a seal member 33 implemented as a sheet of Mylar or rubber, for example, is disposed above the roller 4 to prevent the toner from being scattered to the outside.

If desired, in the device 2 shown in FIG. 1A or 19, a voltage of the same polarity as the charge of the toner and capable of forming a predetermined potential difference between the plate 8 and the roller 4 may be applied to the plate 8. For example, the device 2 of FIG. 19 is implemented with a reversal development system using a positively chargeable toner. In this case, a circuit including a Zener diode 211 (Zener voltage of 100 V) is connected between a bias power source 21 (DC voltage of 500 V and AC voltage of 1000 Vp-p and 1000 Hz) and the roller 4. The Zener diode 211 is capable of maintaining a predetermined voltage stably. The junction F of the circuit is electrically connected to the plate 8 to produce a potential difference of about 100 V between the roller 4 and the plate 8. A power source independent of the bias power source 21 may be used to apply a voltage to the plate 8. The plate 8 has a volume resistance of about $10^3$ Ωcm to about $10^6$ Ωcm. However, when the potential difference between the roller 4 and the plate 8 is as great as 200 V to 300 V, the volume resistance of the plate 8 should preferably be about $10^7$ Ωcm to $10^{10}$ Ωcm in order to eliminate a leak current ascribable to the potential difference.

In such a configuration, the 1000 Vp-p and 1000 Hz AC bias voltage on which DC 500 V is superposed is applied to the plate 8, while the 1000 Vp-p and 1000 Hz AC bias voltage on which DC 400 V is superposed is applied to the roller 4. Since the plate 8 rubs the surface of the roller 4 with the intermediary of the toner, negative charges are injected from the plate 8 into the toner to thereby promote more positive and stable toner charging.

In the device 2 shown in FIG. 1A or 19, a predetermined voltage may be applied to the roller 5 in order to generate between the rollers 4 and 5 electric fields which facilitate the transfer of the toner from the roller 5 to the roller 4 at the contact position B. For example, since the device 2 of FIG. 19 applies the 1000 Vp-p and 1000 Hz AC bias on which DC 400 V is superposed from the power source 21 to the roller 4, it applies a DC voltage of the same polarity as the DC component of the above-mentioned bias and 100 V higher in absolute value, specifically 500 V DC voltage, from the power source 22 to the core of the roller 5. At this instant, the surface layer of the roller 5 has a volume resistance of about $10^3$ Ωcm to about $10^6$ Ωcm. However, when the potential difference between the rollers 4 and 5 is as great as 200 V to 300 V, the volume resistance should preferably be greater than $10^6$ Ωcm so as to eliminate a leak current.

As stated above, the predetermined electric fields generated between the rollers 4 and 5 facilitate the transfer of the toner from the roller 5 to the roller 4. As a result, a greater amount of toner is deposited on the roller 4, i.e., the toner can be deposited in multiple layers more stably.

While the embodiments have been shown and described in relation to a nonmagnetic one component type developer, it is also practicable with a magnetic one component type developer.

In summary, it will be seen that the present invention provides a developing device in which a developer is transferred from a developer supply member to a developer carrier which are so rotated as to move in the same direction at a position where they contact each other. This prevents the developer from a toner storing section from directly reaching part of the developer carrier having moved away from the contact position despite the movement of the developer supply member. Conductive portions connected to ground and dielectric portions each having a small area are distributed regularly or irregularly on the surface of the developer carrier. Such a surface of the developer carrier is charged by friction by the developer supply member with the result that a great number of microfields are formed in the vicinity of the developer carrier. The microfields allow only the developer sufficiently charged by friction at the contact position to form multiple layers on the surface of the developer carrier. Consequently, the toner with a desired amount of charge and containing a minimum of uncharged toner can form multiple layers on the developer carrier and is transferred to an image carrier. Hence, equispeed development can be effected to prevent the developer from increasing in amount at the rear edge portion of an image, whereby an image free from excessive density at the rear edge portion and misregistration of colors is insured. Since the uncharged toner is not transported to a developing region, the contamination of the background and the fall of resolution are also eliminated. Further, since the uncharged toner which is susceptible to the environment is not deposited on the developer carrier, a stable toner layer can be formed on the developer carrier without resorting to a blade or similar extra implementation which would complicate the construction.

A casing included in the developing device is configured such that the inner periphery of a lower wall contacts the developer on the developer supply member over a range extending from a position adjoining a position where the developer is fed to the developer supply member to a position adjoining the above-mentioned contact position. Therefore, no clearance exists between the developer supply member and the lower wall of the casing over such a range. This is successful in preventing the developer from being conveyed in an excessive amount to between the developer carrier and the inner periphery of the casing beneath the developer carrier by the developer supply member and leaking to the outside of the casing.

A seal member is affixed to the lower wall of the casing at the lower edge thereof and held in contact with part of the developer carrier or part of the developer supply member adjoining the contact position. The seal member prevents the developer being transported by the developer supply member from reaching the interface between the developer carrier and the inner periphery of the casing beneath the developer carrier. This eliminates the leakage of the developer more positively.

In the previously mentioned developer supply position, the developer supply member and the inner periphery of the casing beneath the developer supply member define a relatively wide inlet portion. The developer existing in this inlet portion is moved to a sequentially decreasing clearance and then to the area where the developer supply member contacts the inner periphery of the casing due to the movement of the developer supply member. Hence, the developer from the toner storing section can be smoothly brought to the developer supply member.

The moving speed of the surface of the developer supply member is so selected as not to exceed the upper limit of a particular range of relative speed of the surface of the developer supply member to that of developer carrier in which the amount of toner supply to the developer carrier can be increased without excessively increasing the load for driving the developer supply member. This eliminates the wasteful increase in the load and thereby promotes power saving and noise reduction.

A regulating member contacts the developer supply member at the lower edge thereof. Hence, the uncharged developer in the developer storing section is prevented from directly advancing toward part of the developer carrier located on the downstream side of the contact position with respect to the direction of movement of the developer carrier. This further stabilizes the deposition of a charge on the developer.

A leveling member contacts part of the developer carrier on the downstream side of the contact position with respect to the direction of movement of the developer carrier. The leveling member uniformizes the thickness of the developer on the developer carrier while preventing the developer staying below the developer carrier from leaking to the outside. Therefore, even when the surface of the developer carrier is moved toward the image carrier on the inner periphery of the casing beneath the developer carrier, the developer can form multiple layers in a stable amount and with a stable charge. The surface of the developer carrier is moved toward the image carrier on the inner periphery of the casing below the developer carrier, while the surface of the developer supply member is moved in the same direction as that of the developer carrier at the contact position. Hence, the developer accumulated below the developer carrier is returned to the developer storing section. Consequently, the developer is prevented from dropping or leaking via the position where the leveling member and developer carrier contact, forming multiple layers more stably.

Furthermore, the leveling member is made of a material having a low resistance. A voltage capable of forming a predetermined potential between the leveling member and the developer carrier is applied to the leveling member. As a result, a charge of predetermined polarity is injected from the leveling member into the developer to further enhance the stable charging of the developer layer.

In addition, a voltage capable of forming electric fields which promote the transfer of the developer from the developer supply member to the developer carrier is applied to the developer supply member made of a material having a low resistance. The electric fields generated in a gap at or in the vicinity of the contact position of the developer carrier and developer supply member causes the developer in the gap to move toward the surface of the developer carrier. Therefore, the developer is fed in a greater amount to the surface of the developer carrier and forms the layers more stably.

Various modifications will become possible for those skilled in the art after receiving the teachings of the present disclosure without departing from the scope thereof.

What is claimed is:

1. A developing device incorporated in image forming equipment for developing a latent image electrostatically formed on an image carrier by a developer to produce a visible image, said device comprising:

a developer carrier driven to move a surface thereof and having both conductive portions connected to ground and dielectric portions distributed on said surface, wherein said surface of said developer carrier including said conductive portions and said dielectric portions is substantially smooth such that said developer carrier has a continuous smooth surface;

a developer supply member driven to move a surface thereof while contacting the surface of said developer carrier for supplying the developer to said developer carrier, wherein the developer supply member and the developer carrier are rotated in opposite directions such that said surface of said developer supply member is moved in the same direction as said surface of said developer carrier at a contact position where said surfaces contact each other;

wherein a plurality of microfields are formed in the vicinity of the surface of said developer carrier due to friction between said developer supply member and said developer carrier, and the developer charged by friction at said contact position is deposited in a layer on said developer carrier by said microfields; and a levelling member contacting the surface of said developer at a pressure between 10 g/cm and 20 g/cm.

2. A developing device incorporated in image forming equipment for developing a latent image electrostatically formed on an image carrier by a developer to produce a visible image, said device comprising:

a developer carrier driven to move a surface thereof and having both conductive portions connected to ground and dielectric portions distributed on said surface, wherein said surface of said developer carrier including said conductive portions and said dielectric portions is substantially smooth such that said developer carrier has a continuous smooth surface;

a developer supply member driven to move a surface thereof while contacting the surface of said developer carrier for supplying the developer to said developer carrier;

wherein a plurality of microfields are formed in the vicinity of the surface of said developer carrier due to friction between said developer supply member and said developer carrier, and the developer charged by friction at said contact position is deposited in a layer on said developer carrier by said microfields; and wherein the surface of said developer supply member is moved toward said developer carrier on an inner periphery of a lower wall of a casing included in said device.

3. A device as claimed in claim 2, and further wherein the developer supply member and the developer carrier are rotated in opposite directions such that said surface of said developer supply member is moved in the same direction as said surface of said developer carrier at a contact position where said surfaces contact each other.

4. A developing device incorporated in image forming equipment for developing a latent image electrostatically formed on an image carrier by a developer to produce a visible image, said device comprising:

a developer carrier driven to move a surface thereof and having conductive portions connected to ground and dielectric portions distributed on said surface together with said conductive portions;

a developer supply member driven to move a surface thereof while contacting the surface of said developer carrier for supplying the developer to said developer carrier;

wherein a plurality of microfields are formed in the vicinity of the surface of said developer carrier due to friction between said developer supply member and said developer carrier, and the developer charged by friction at said contact position is deposited in a layer on said developer carrier by said microfields;

wherein the surface of said developer supply member is moved toward said developer carrier on an inner periphery of a lower wall of a casing included in said device; and wherein the inner periphery of said lower wall of said casing is configured to contact the surface of said developer supply member over a range extending from a position adjoining a supply position where the developer is supplied to said developer supply member to a position adjoining said contact position.

5. A device as claimed in claim 4, further comprising a seal member having a lower edge affixed to said lower wall of said casing and contacting at an upper edge part of the surface of said developer carrier or part of the surface of said developer supply member adjoining said contact position.

6. A device as claimed in claim 4, wherein at said supply position the inner periphery of said lower wall of said casing is spaced apart from the surface of said developer supply member by a generally wedge-shaped clearance which is tapered toward a downstream side with respect to the direction in which said surface of said developer supply member is moved.

7. A device as claimed in claims 4, further including means for driving the developer supply member to move the surface of said developer supply member at a speed not greater than 1.5 times as high as the surface of said developer carrier.

8. A device as claimed in claim 4, and further wherein the developer supply member and the developer carrier are rotated in opposite directions such that said surface of said developer supply member is moved in the same direction as said surface of said developer carrier at a contact position where said surfaces contact each other.

9. A developing device incorporated in image forming equipment for developing a latent image electrostatically formed on an image carrier by a developer to produce a visible image, said device comprising:

a developer carrier driven to move a surface thereof and having conductive portions connected to ground and dielectric portions distributed on said surface together with said conductive portions;

a developer supply member driven to move a surface thereof while contacting the surface of said developer carrier for supplying the developer to said developer carrier;

wherein a plurality of microfields are formed in the vicinity of the surface of said developer carrier due to friction between said developer supply member and said developer carrier, and the developer charged by friction at said contact position is deposited in a layer on said developer carrier by said microfields;

wherein the surface of said developer supply member is moved toward said developer carrier on an inner periphery of a lower .wall of a casing included in said device; and the developing device further comprising a regulating member having a lower edge contacting the surface of said developer supply member to prevent the developer from directly advancing toward part of the surface of said developer carrier downstream of said contact position with respect to the direction in which said surface of said developer carrier is moved.

10. A device as claimed in claim 9, and further wherein the developer supply member and the developer carrier are rotated in opposite directions such that said surface of said developer supply member is moved in the same direction as said surface of said developer carrier at a contact position where said surfaces contact each other.

11. A developing device incorporated in image forming equipment for developing a latent image electrostatically formed on an image carrier by a developer to produce a visible image, said device comprising:

a developer carrier driven to move a surface thereof and having conductive portions connected to ground and dielectric portions distributed on said surface together with said conductive portions;

a developer supply member driven to move a surface thereof while contacting the surface of said developer carrier for supplying the developer to said developer carrier, wherein the developer supply member and the developer carrier are rotated in opposite directions such that said surface of said developer supply member is moved in the same direction as said surface of said developer carrier at a contact position where said surfaces contact each other;

wherein a plurality of microfields are formed in the vicinity of the surface of said developer carrier due to friction between said developer supply member and said developer carrier, and the developer charged by friction at said contact position is deposited in a layer on said developer carrier by said microfields;

a levelling member contacting part of the surface of said developer carrier downstream of said contact position with respect to the direction in which said surface of said developer carrier is moved, wherein the levelling member contacts the surface of said developer carrier at a pressure between 10 g/cm and 20 g/cm.

12. A developing device incorporated in image forming equipment for developing a latent image electrostatically formed on an image carrier by a developer to produce a visible image, said device comprising:

a developer carrier driven to move a surface thereof and having conductive portions connected to ground and dielectric portions distributed on said surface together with said conductive portions;

a developer supply member driven to move a surface thereof while contacting the surface of said developer carrier for supplying the developer to said developer carrier;

wherein a plurality of microfields are formed in the vicinity of the surface of said developer carrier due to friction between said developer supply member and said developer carrier, and the developer charged by friction at said contact position is deposited in a layer on said developer carrier by said microfields;

wherein the surface of said developer supply member is moved toward said developer carrier on an inner periphery of a lower wall of a casing included in said device; and further comprising a levelling member contacting part of the surface of said developer carrier downstream of said contact position with respect to the direction in which said surface of said developer carrier is moved, wherein said levelling member is made of a material having a low resistance.

13. A device as claimed in claim 12, further comprising voltage applying means for applying to said leveling member a voltage of the same polarity as the developer and capable of producing a predetermined potential difference between said leveling member and the surface of said developer carrier.

14. A device as claimed in claim 12, and further wherein the developer supply member and the developer carrier are rotated in opposite directions such that said surface of said developer supply member is moved in the same direction as said surface of said developer carrier at a contact position where said surfaces contact each other.

15. A developing device incorporated in image forming equipment for developing a latent image electrostatically formed on an image carrier by a developer to produce a visible image., said device comprising:

a developer carrier driven to move a surface thereof and having both conductive portions connected to ground and dielectric portions distributed on said surface, wherein said surface of said developer carrier including said conductive portions and said dielectric portions is substantially smooth such that said developer carrier has a continuous smooth surface;

a developer supply member driven to move a surface thereof while contacting the surface of said developer carrier for supplying the developer to said developer carrier;

wherein a plurality of microfields are formed in the vicinity of the surface of said developer carrier due to friction between said developer supply member and said developer carrier, and the developer charged by friction at said contact position is deposited in a layer on said developer carrier by said microfields; and wherein said developer supply member is made of a material having a low resistance.

16. A device as claimed in claim 15, further comprising voltage applying means for applying to said developer supply member a voltage capable of forming an electric field which transfers the developer from said developer supply member to the surface of said developer carrier.

17. A device as claimed in claim 15, and further wherein the developer supply member and the developer carrier are rotated in opposite directions such that said surface of said developer supply member is moved in the same direction as said surface of said developer carrier at a contact position where said surfaces contact each other.

18. A developing device for an image forming apparatus for developing a latent image electrostatically formed on an image carrier by a developer to thereby produce a visible image, said device comprising:

a driven developer carrier having a surface which moves as said developer carrier is driven;

a driven developer supply member having a surface which contacts the surface of said driven developer carrier, wherein said developer carrier carries developer to a developing location downstream from said contact position, such that developer is transferred to an image carrier at said developing location; and means for forming a plurality of microfields on the surface of said developer carrier by friction between the developer supply member and the developer carrier such that developer charged by friction at said contact position is deposited in a layer on said developer carrier by said microfields, said means for providing a plurality of microfields by friction including conductive portions provided in the surface of said developer carrier, said conductive portions connected to ground, and dielectric portions distribution on said surface of said developer carrier;

said developing device further including means for preventing developer which has not passed through said contact position from being carried by said developer carrier toward said developing location.

19. The developing device of claim 18, wherein said dielectric portions comprise 40%–70% of the surface of the developer carrier.

20. A device as claimed in claim 18, and further wherein the developer supply member and the developer carrier are rotated in opposite directions such that said surface of said developer supply member is moved in the same direction as said surface of said developer carrier at a contact position where said surfaces contact each other.

21. A developing device incorporated in image forming equipment for developing a latent image electrostatically formed on an image carrier by a developer to produce a visible image, said device comprising:

a developer carrier driven to move a surface thereof and having both conductive portions connected to ground and dielectric portions distributed on said surface, wherein said surface of said developer carrier including said conductive portions and said dielectric portions is substantially smooth such that said developer carrier has a continuous smooth surface;

a developer supply member driven to move a surface thereof while contacting the surface of said developer carrier for supplying the developer to said developer carrier; and means for preventing developer which has not passed through said contact position from being carried by said developer carrier toward an image carrier;

wherein a plurality of microfields are formed in the vicinity of the surface of said developer carrier due to friction between said developer supply member and said developer carrier, and the developer charged by friction at said contact position is deposited in a layer on said developer carrier by said microfields.

22. The developing device of claim 21, wherein said means for preventing includes a wall having a portion disposed adjacent said developer supply member to thereby regulate a developer level in a region of said contact position.

23. The developing device of claim 21, wherein said means for preventing includes moving said developer supply member such that developer is moved upwardly as developer is fed toward and through said contact position.

24. The developing device of claim 23, wherein said means for preventing further includes a lower wall portion of a casing of the developing device which contacts at least a portion of said developer supply member at a location upstream of said contact position.

25. The developing device of claim 21, wherein said means for preventing includes a seal which contacts said developer supply member on an upper surface location of said developer supply member.

26. A device as claimed in claim 21, and further wherein the developer supply member and the developer carrier are rotated in opposite directions such that said surface of said developer supply member is moved in the same direction as said surface of said developer carrier at a contact position where said surfaces contact each other.

* * * * *